US012338570B2

(12) United States Patent
Yeom et al.

(10) Patent No.: US 12,338,570 B2
(45) Date of Patent: Jun. 24, 2025

(54) DRYER

(71) Applicant: SAMSUNG ELECTRONICS CO., LTD., Suwon-si (KR)

(72) Inventors: Changbae Yeom, Suwon-si (KR); Yeonju Lee, Suwon-si (KR); Hyemin Cha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 779 days.

(21) Appl. No.: 17/563,666

(22) Filed: Dec. 28, 2021

(65) Prior Publication Data

US 2022/0162795 A1 May 26, 2022

Related U.S. Application Data

(63) Continuation of application No. PCT/KR2021/014980, filed on Oct. 25, 2021.

(30) Foreign Application Priority Data

Nov. 20, 2020 (KR) ..... 10-2020-0156628
Mar. 17, 2021 (KR) ..... 10-2021-0034627

(51) Int. Cl.
*D06F 58/26* (2006.01)

(52) U.S. Cl.
CPC ..... *D06F 58/26* (2013.01)

(58) Field of Classification Search
CPC ..... D06F 58/26
(Continued)

(56) References Cited

U.S. PATENT DOCUMENTS 2,627,669 A * 2/1953 Candor ..... D06F 58/206 62/331
2,866,273 A * 12/1958 Geldhof ..... D06F 58/02 261/115
(Continued)

FOREIGN PATENT DOCUMENTS

CN 101173463 B 12/2010
CN 115404635 A * 11/2022 ..... D06F 29/005
(Continued)

OTHER PUBLICATIONS

PCT/ISA/210 dated Feb. 24, 2022 in International Patent Application No. PCT/KR2021/014980.
(Continued)

*Primary Examiner* — Stephen M Gravini
(74) *Attorney, Agent, or Firm* — STAAS & HALSEY LLP

(57) ABSTRACT

A dryer includes a cabinet, a drum disposed inside the cabinet to accommodate an object to be dried, a first opening disposed on a front side of the cabinet to enable the object to be dried to be placed into the drum, a heat exchanger disposed inside the cabinet to exchange heat with air, a second opening disposed on the front side of the cabinet, and a dehumidification unit. The dehumidification unit is configured to supply outside air to the heat exchanger and air supplied to the heat exchanger is circulated from the heat exchanger into the drum and discharged from the drum to the dehumidification unit. The air discharged from the drum to the dehumidification unit is then discharged outside of the cabinet by the dehumidification unit.

15 Claims, 31 Drawing Sheets

(58) Field of Classification Search
USPC ..... 34/607
See application file for complete search history.

(56) References Cited

U.S. PATENT DOCUMENTS

| | | | | | |
|---|---|---|---|---|---|
| 3,064,358 | A * | 11/1962 | Giuffre | D06F 58/206 62/93 |
| 4,467,785 | A * | 8/1984 | Langford | B01D 53/261 95/122 |
| 7,347,009 | B2 * | 3/2008 | Ahn | D06F 58/206 34/607 |
| 9,207,015 | B2 * | 12/2015 | Ahn | F26B 21/086 |
| 9,249,538 | B2 * | 2/2016 | Bison | D06F 58/24 |
| 12,071,721 | B2 * | 8/2024 | Cavarretta | D06F 58/20 |
| 2007/0163097 | A1 * | 7/2007 | Metcalfe | D06F 58/203 28/100 |
| 2021/0301449 | A1 * | 9/2021 | Cho | D06F 58/45 |
| 2022/0162795 | A1 * | 5/2022 | Yeom | D06F 58/26 |
| 2022/0356635 | A1 * | 11/2022 | Yoon | D06F 58/36 |
| 2022/0380971 | A1 * | 12/2022 | Lee | D06F 73/02 |

FOREIGN PATENT DOCUMENTS

| | | | | |
|---|---|---|---|---|
| DE | 10 2012 212 162 | A1 | 1/2014 | |
| DE | 202013104698 | U1 * | 3/2014 | D06F 58/02 |
| EP | 2 684 994 | B1 | 9/2016 | |
| EP | 4023809 | A1 * | 7/2022 | D06F 58/26 |
| EP | 4095300 | A1 * | 11/2022 | D06F 29/005 |
| JP | 2004-340407 | | 12/2004 | |
| JP | 2007-68870 | | 3/2007 | |
| JP | 2007-143711 | A | 6/2007 | |
| JP | 2019-92900 | | 6/2019 | |
| KR | 10-0481198 | | 4/2005 | |
| KR | 10-0595763 | B1 | 6/2006 | |
| KR | 10-0974677 | | 8/2010 | |
| KR | 10-2013-0005724 | | 1/2013 | |
| KR | 10-2019-0000147 | | 1/2019 | |

OTHER PUBLICATIONS

Extended European Search Report dated Oct. 20, 2022 for European Application No. 21806942.5.

European Office Action dated Jun. 8, 2022 in European Patent Application No. 21 806 942.5 (2 pages).

European Office Action dated Aug. 20, 2024 for European Application No. 21806942.5.

* cited by examiner

DRYER

CROSS-REFERENCE TO RELATED APPLICATIONS

This application is a continuation application under 35 U.S.C. § 111(a) of International Application No. PCT/KR2021/014980, filed on Oct. 25, 2021, which claims priority to Korean Patent Application No. 10-2020-0156628 filed on Nov. 20, 2020, and Korean Patent Application No. 10-2021-0034627 filed on Mar. 17, 2021. Each of the disclosures of International Application No. PCT/KR2021/014980, Korean Patent Application No. 10-2020-0156628, and Korean Patent Application No. 10-2021-0034627, are incorporated by reference herein in their entirety.

BACKGROUND

1. Field

The disclosure relates to a dryer, and for example, a dryer capable of performing a dehumidification function.

2. Description of the Related Art

A dryer includes a device that blows hot air (e.g., high-temperature and dry air) into a drum to dry an object contained in the drum. As a general example of the dryer, a clothes dryer for drying washed-wet-laundry is widely used.

In general, a clothes dryer may be installed and used in a separate laundry room or utility room in the house. The laundry room or utility room may not have windows or may be small, so that ventilation is not performed well. When a humidity in the laundry room or utility room is high, the clothes dryer installed there may be corroded, and the high humidity may cause discomfort to users who use the room.

The dryer may dry an object to be dried using a refrigerant cycle. For example, the dryer may remove moisture from humid air flowing from the drum, raise a temperature of the air, and then return the air to the drum for circulation. That is, because the dryer dries the object to be dried through a process of air circulation, a closed flow path is formed inside a main body.

A dehumidifier includes a device used to remove moisture. The dehumidifier suctions air from outside of the dehumidifier, removes moisture, raises a temperature of the air, and then discharges the dehumidified air to the outside. That is, an open flow path is formed inside the dehumidifier.

A dehumidifier may be installed to control a humidity of a space where the dryer is installed, but the laundry room or utility room may be relatively small, so an installation space for the dehumidifier may not be sufficient. Additionally, it is quite inefficient to purchase a separate dehumidifier.

SUMMARY

Aspects of the disclosure will be set forth in part in the description which follows and, in part, will be apparent from the description, or may be learned by practice of the described embodiments.

One or more aspects of the disclosure are directed to providing a dryer capable of not only drying an object to be dried but also dehumidifying a surrounding space.

Further, one or more aspects of the disclosure are directed to providing a dryer capable of easily recognizing whether a dehumidification unit, which is mounted in order for the dryer to operate a dehumidifying mode, is installed or not.

Further, one or more aspects of the disclosure are directed to providing a dryer capable of easily switching between a drying mode for drying clothes and a dehumidifying mode for indoor dehumidification.

Described herein is a dryer including a cabinet, a drum disposed inside the cabinet to accommodate an object to be dried, a first opening disposed on a front side (or front surface) of the cabinet to enable an object to be dried to be placed in the drum, a heat exchanger disposed inside the cabinet to exchange heat with air, a second opening disposed on the front side (or front surface) of the cabinet and through which the heat exchanger is accessible, and a dehumidification unit, which is mountable to the cabinet through the second opening. The dehumidification unit may be configured to discharge air, which is discharged from the drum, to an outside of the cabinet and to supply outside air to the heat exchanger. The dehumidification unit may include an inlet port disposed on a front side of the dehumidification unit to allow air to be introduced through the second opening. The dehumidification unit may include a discharge port disposed on a rear side of the dehumidification unit to guide the air, which is introduced through the inlet port, to the heat exchanger. The air guided to the heat exchanger may be circulated from the heat exchanger into the drum and discharged from the drum. The dehumidification unit may include an intake port disposed on a lateral side of the dehumidification unit to allow the air, which is discharged from the drum, to be introduced into the intake port. The dehumidification unit may include an outlet port disposed on the front side of the dehumidification unit to allow the air, which is introduced through the intake port into the outlet port, to be discharged through the second opening. The dehumidification unit may include a guide disposed to partition a first flow path extending from the inlet port to the discharge port and a second flow path extending from the intake port to the outlet port.

According to the preceding paragraphs, the inlet port and the outlet port may be disposed adjacent to one another (e.g., side by side in a left and right direction).

According to the preceding paragraphs, the drum may be rotatably arranged in the cabinet, and the dryer may further include a fan arranged in a middle of a flow path from an entrance of the drum to the intake port.

According to the preceding paragraphs, with respect to a vertical line passing through a center of the first opening, the outlet port may be disposed closer to the vertical line than the inlet port.

According to the preceding paragraphs, the guide may include a curved portion to form a curved section in the second flow path.

According to the preceding paragraphs, the dryer may further include a discharge rib disposed to protrude from the guide horizontally to at least partially divide the second flow path into upper and lower regions.

According to the preceding paragraphs, the inlet port may be disposed on a right side of the outlet port. The inlet port may include a plurality of inlet guide ribs extending in an oblique direction disposed in the inlet port to allow air to be introduced from a lower right direction. The outlet port may include a plurality of outlet guide ribs extending in an oblique direction disposed in the outlet port to allow air to be discharged to an upper left direction.

According to the preceding paragraphs, the dehumidification unit may further include at least one of a suction filter disposed to filter out foreign substances in air introduced through the inlet port, and an exhaust filter disposed to filter out foreign substances in air to be discharged through the outlet port. That is, the dehumidification unit may include the suction filter, the exhaust filter, or both the suction filter and the exhaust filter.

According to the preceding paragraphs, the dehumidification unit may include an identification portion configured to allow the dryer to detect whether the dehumidification unit is mounted. For example, the dryer may be configured to detect whether the dehumidification unit is mounted to the cabinet based on the identification portion.

According to the preceding paragraphs, an area occupied by the inlet port and an area occupied by the outlet port may be the same.

According to an example of the disclosure, a dryer may include a cabinet, a drum rotatably disposed inside the cabinet to accommodate an object to be dried, a first opening disposed on a front side (or front surface) of the cabinet to enable an object to be dried to be placed in the drum, a heat exchanger disposed inside the cabinet to exchange heat with air, a second opening disposed on the front side (or front surface) of the cabinet and through which the heat exchanger is accessible, and a dehumidification unit, which is mountable to the cabinet through the second opening. The dehumidification unit may be configured to discharge air, which is discharged from the drum, to an outside of the cabinet and to supply outside air to the heat exchanger. The dehumidification unit may include an inlet port disposed on a front side of the dehumidification unit to allow air to be introduced through the second opening into the discharge port, and a discharge port provided to guide the air, which is introduced through the inlet port into the discharge port, to the heat exchanger. The air guided to the heat exchanger may be circulated from the heat exchanger into the drum and discharged from the drum. The dehumidification unit may further include an intake port provided to allow the air, which is discharged from the drum, to be introduced into the intake port, an outlet port disposed on the front side of the dehumidification unit to allow the air, which is introduced through the intake port into the outlet port, to be discharged through the second opening, a guide disposed to partition a first flow path extending from the inlet port to the discharge port and a second flow path extending from the intake port to the outlet port, and a protrusion disposed to protrude beyond the front side of the cabinet in a state in which the dehumidification unit is mounted to the cabinet. That is, when the dehumidification unit is mounted to the cabinet, the protrusion protrudes outwardly beyond the front side of the cabinet.

According to the preceding paragraphs, the protrusion may be disposed between the inlet port and the outlet port.

According to the preceding paragraphs, the dryer may further include a unit cover configured to open and close the second opening, and the unit cover may not be closed in a state in which the dehumidification unit is mounted. That is, in a state in which the dehumidification unit is mounted to the cabinet, the unit cover is in an open position and is prevented from being moved to the closed position by the protrusion.

According to an example of the disclosure a dryer includes a cabinet, a drum rotatably disposed inside the cabinet to accommodate an object to be dried, a first opening disposed on a front side (or front surface) of the cabinet to enable an object to be dried to be placed in the drum, a heat exchanger disposed inside the cabinet to exchange heat with air, a second opening disposed on the front side (or front surface) of the cabinet and through which the heat exchanger is accessible, and a dehumidification unit, mountable to the cabinet through the second opening, and detachable from the cabinet. The dehumidification unit may be configured to discharge air, which is discharged from the drum, to an outside of the cabinet and to supply outside air to the heat exchanger. The dehumidification unit may include an inlet port disposed on a front side of the dehumidification unit to allow air to be introduced through the second opening into the inlet port, and a discharge port provided to guide the air, which is introduced through the inlet port into the discharge port, to the heat exchanger. The air guided to the heat exchanger may be circulated from the heat exchanger into the drum and discharged from the drum. The dehumidification unit may further include an intake port provided to allow the air, which is discharged from the drum, to be introduced into the intake port, an outlet port disposed on the front side of the dehumidification unit to allow the air, which is introduced through the intake port into the outlet port, to be discharged to outside of the cabinet through the second opening, and a guide disposed to form a flow path inside the dehumidification unit. The guide may be moveable between a first position at which the guide partitions a first flow path extending from the inlet port to the discharge port and a second flow path extending from the intake port to the outlet port, and a second position at which a third flow path extending from the intake port to the discharge port is formed.

According to the preceding paragraphs, the guide may be rotatably disposed (i.e., the guide may be rotatable), and the guide may be rotatable between the first position and the second position.

According to the preceding paragraphs, the inlet port and the outlet port may be disposed adjacent to one another (e.g., side by side in a left and right direction).

According to an example of the disclosure a dryer includes a cabinet, a drum rotatably disposed inside the cabinet to accommodate an object to be dried, a first opening disposed on a front side (or front surface) of the cabinet to enable an object to be dried to be placed in the drum, a heat exchanger disposed inside the cabinet to exchange heat with air, a second opening disposed on the front side (or front surface) of the cabinet and through which a unit accommodating portion is accessible inside the cabinet, a filter unit disposed to be detachably mounted on the unit accommodating portion through the second opening, and disposed to provide a first flow path disposed to supply air, which is discharged from the drum, to the heat exchanger, and a dehumidification unit disposed to be detachably mounted on the unit accommodating portion when the filter unit is removed from the cabinet, and disposed to provide a second flow path disposed to discharge the air, which is discharged from the drum, to an outside of the cabinet, and a third flow path disposed to supply outside air to the heat exchanger. That is, the dehumidification unit is interchangeable with the filter unit. A first identification portion may be disposed in the filter unit, and a second identification portion may be disposed in the dehumidification unit. The dryer may include a first sensor configured to detect the first identification portion disposed in the filter unit and may correspond to the first identification portion. The dryer may include a second sensor configured to detect a second identification portion disposed in the dehumidification unit and may correspond to the second identification portion.

According to the preceding paragraphs, the dryer may further include a unit cover configured to open and close the second opening, and the unit cover may not be closed in a state in which the dehumidification unit is mounted.

According to the preceding paragraphs, the dehumidification unit may further include a guide disposed to partition the second flow path and the third flow path.

According to the preceding paragraphs, the dryer may further include a controller configured to determine whether to perform a dehumidifying operation in a dehumidifying mode using the dehumidification unit, based on information (e.g., a signal) received from the second sensor.

According to an example of the disclosure a dryer includes a cabinet, a drum disposed inside the cabinet, a heat exchanger disposed inside the cabinet, and a dehumidification unit. The dehumidification unit may be configured to introduce air from outside the cabinet to the heat exchanger via a first flow path disposed in the dehumidification unit, to lower a humidity of the air. For example, the air may be introduced from the outside via an inlet port disposed on a front side of the dehumidification unit, and may be discharged to the heat exchanger via a discharge port disposed on a rear side of the dehumidification unit. The dehumidification unit may be configured to receive, via the drum, the air having the lowered humidity that has passed through the heat exchanger, and to discharge the received air having the lowered humidity to the outside of the cabinet via a second flow path disposed in the dehumidification unit and partitioned from the first flow path. According to an example of the disclosure a dryer includes a cabinet, a drum disposed inside the cabinet, a heat exchanger disposed inside the cabinet, and a dehumidification unit. The dehumidification unit may include a first flow path extending from an inlet port of the dehumidification unit and through which outside air is to be introduced into the dehumidification unit and a discharge port of the dehumidification unit and from which the outside air introduced into the dehumidification unit via the inlet port is to be discharged to the heat exchanger. The dehumidification unit may further include a second flow path, partitioned from the first flow path and extending from an intake port of the dehumidification unit to an outlet port of the dehumidification unit, wherein the intake port is to receive air that has passed through the heat exchanger and is discharged from the drum, and the outlet port is to discharge the air received by the intake port to outside of the cabinet.

According to an example of the disclosure a dehumidification unit is mountable to a dryer having a cabinet, a heat exchanger, and a drum. The dehumidification unit includes a body, an inlet port disposed on a front side of the body that, when the dehumidification unit is mounted to the dryer, is to allow air outside of the cabinet to be introduced through an opening of the cabinet into the inlet port, a discharge port disposed on a rear side of the body that, when the dehumidification unit is mounted to the dryer, is to guide the air, which is introduced through the inlet port into the discharge port, to the heat exchanger, an intake port disposed on a lateral side of the body that, when the dehumidification unit is mounted to the dryer and the air guided to the heat exchanger from the discharge port is circulated from the heat exchanger into the drum and discharged from the drum, is to allow the air discharged from the drum to be introduced into the intake port, and an outlet port disposed on the front side of the body that, when the dehumidification unit is mounted to the dryer, is to allow the air, which is introduced through the intake port into the outlet port, to be discharged through the opening of the cabinet. The dehumidification unit may further include a guide disposed to partition a first flow path extending from the inlet port to the discharge port and a second flow path extending from the intake port to the outlet port.

According to an example of the disclosure a dryer includes a cabinet, a drum disposed inside the cabinet, a heat exchanger disposed inside the cabinet, a controller, a plurality of sensors, and an accommodating portion which a dehumidification unit or a filter are mountable. The controller may include a processor and a non-transitory computer readable storage medium that stores instructions executable by the processor. For example in response to receiving information from a first sensor among the plurality of sensors indicating the dehumidification unit is mounted, the instructions may include switching the dryer to a dehumidifying mode. For example in response to receiving information from a second sensor among the plurality of sensors indicating the filter unit is mounted, the instructions may include switching the dryer to a drying mode. For example in response to receiving information from a third sensor among the plurality of sensors indicating the drum is not empty while the dryer is in the dehumidifying mode, the instructions may include preventing a dehumidifying operation in the dehumidifying mode from being performed. For example, in response to receiving information from a fourth sensor indicating a position of the guide, the instructions may include switching to a dehumidifying mode or a drying mode, based on the position of the guide.

DETAILED DESCRIPTION

Figure 1:
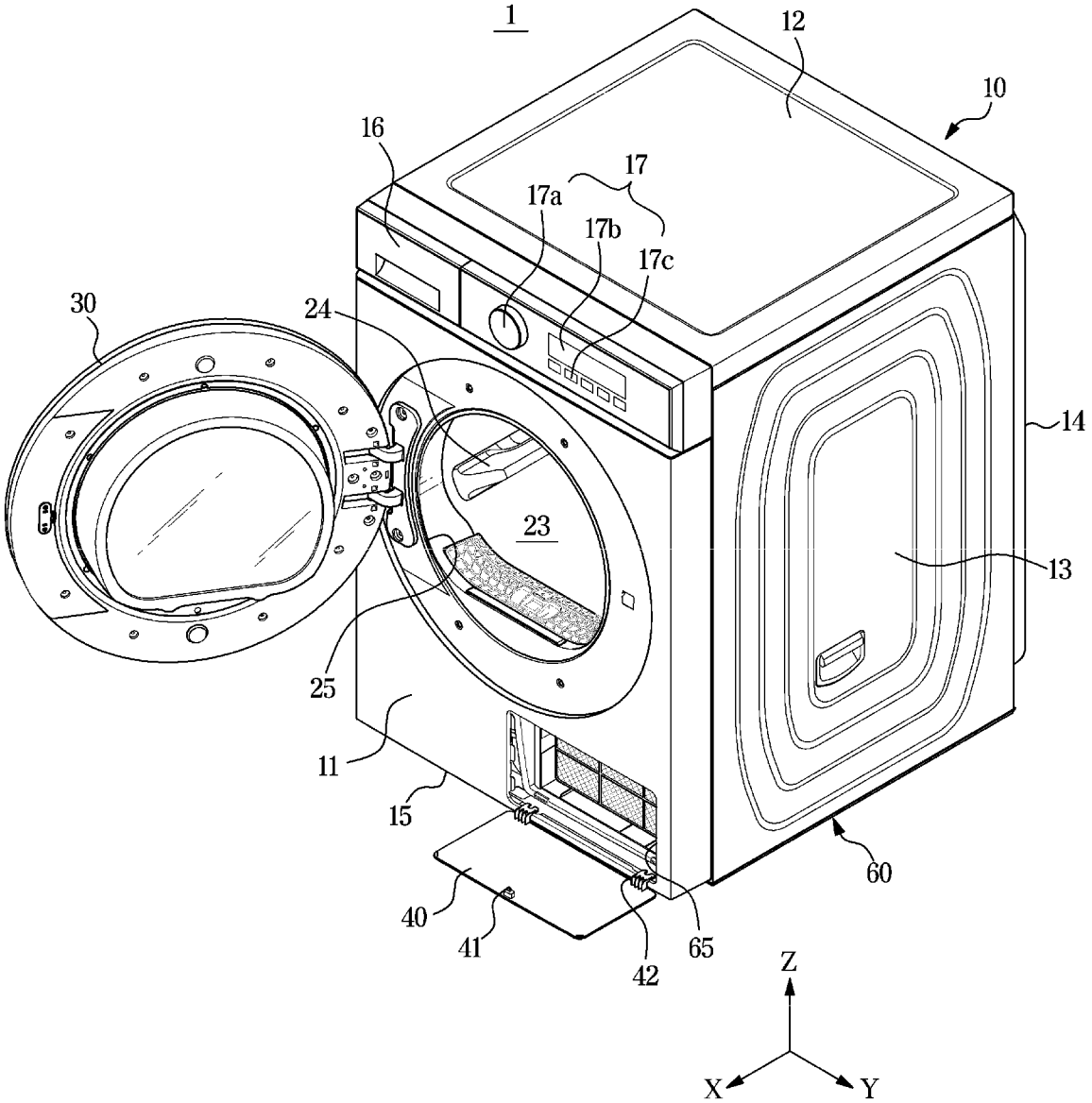
FIG. 1 is a view of a dryer according to an embodiment of the disclosure.

Embodiments described in the disclosure and configurations shown in the drawings are merely examples of the embodiments of the disclosure, and may be modified in various different ways.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

When it is stated in the disclosure that one element is "connected to" or "coupled to" another element, the expression encompasses an example of a direct connection or direct coupling, as well as a connection or coupling with another element interposed therebetween.

It will be understood that, although the terms first, second, third, etc., may be used herein to describe various elements, the elements are not limited by these terms. These terms are used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items. For example, the scope of the expression or phrase "A and/or B" includes the item "A", the item "B", and the combination of items "A and B".

In addition, the scope of the expression or phrase "at least one of A and B" is intended to include all of the following: (1) at least one of A, (2) at least one of B, and (3) at least one A and at least one of B. For example, the scope of the expression or phrase "at least one of A, B, and C" is intended to include all of the following: (1) at least one of A, (2) at least one of B, (3) at least one of C, (4) at least one of A and at least one of B, (5) at least one of A and at least one of C, (6) at least one of B and at least one of C, and (7) at least one of A, at least one of B, and at least one of C.

According to examples described herein, a dryer may perform a dehumidification function as well as a drying function.

Further, according to examples described herein, a dryer may easily recognize whether a dehumidification unit is mounted or not.

Further, according to examples described herein, a dryer may easily switch between a drying mode and a dehumidifying mode.

Hereinafter example embodiments of the disclosure will be described in detail with reference to the accompanying drawings. Dryers 1 and 2 according to embodiments of the disclosure may be used to dry and/or take care of clothes, shoes, miscellaneous goods, and the like.

Figure 2:
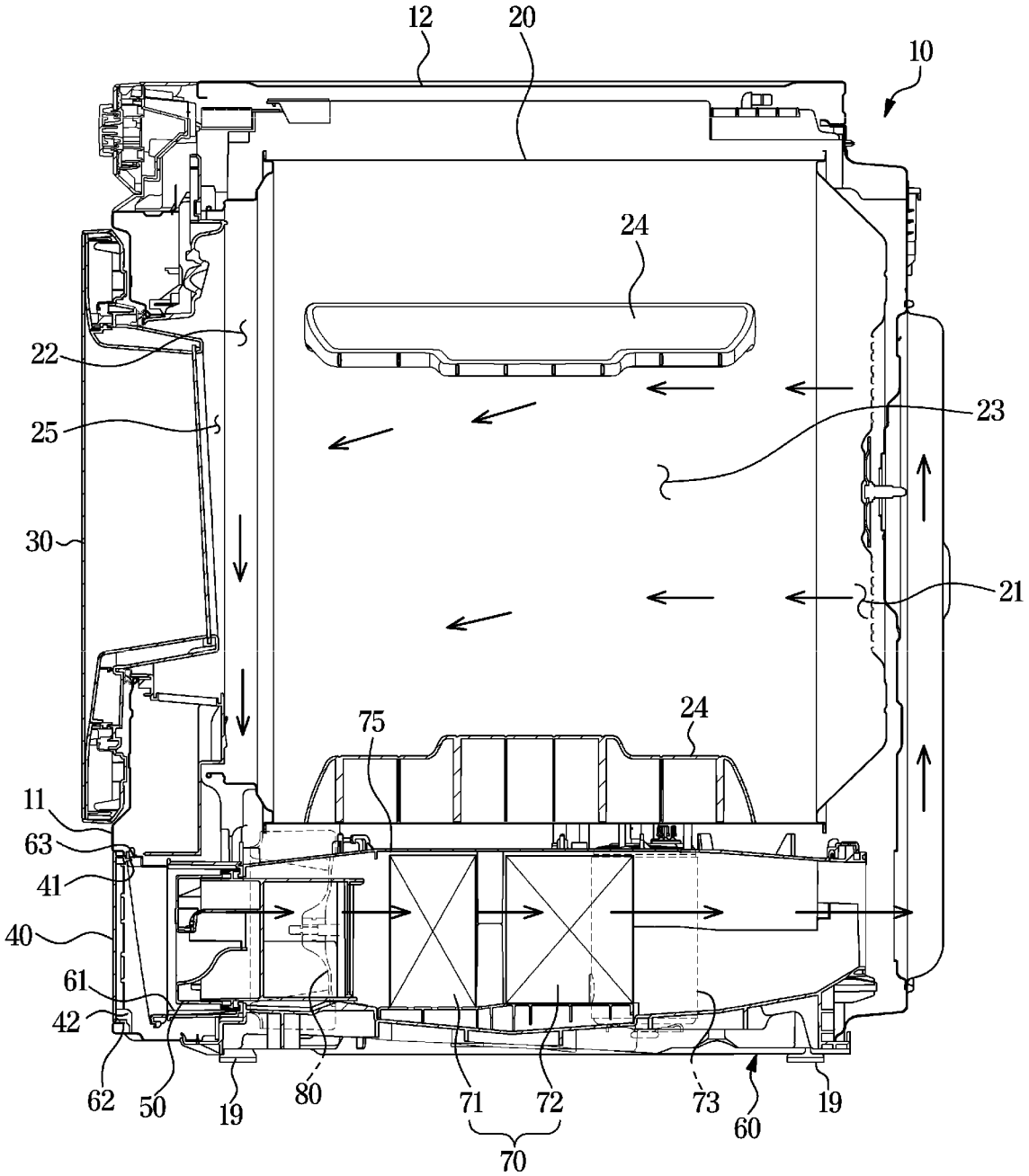
FIG. 2 is a vertical cross-sectional view of the dryer to which a filter unit is mounted.
Figure 3:
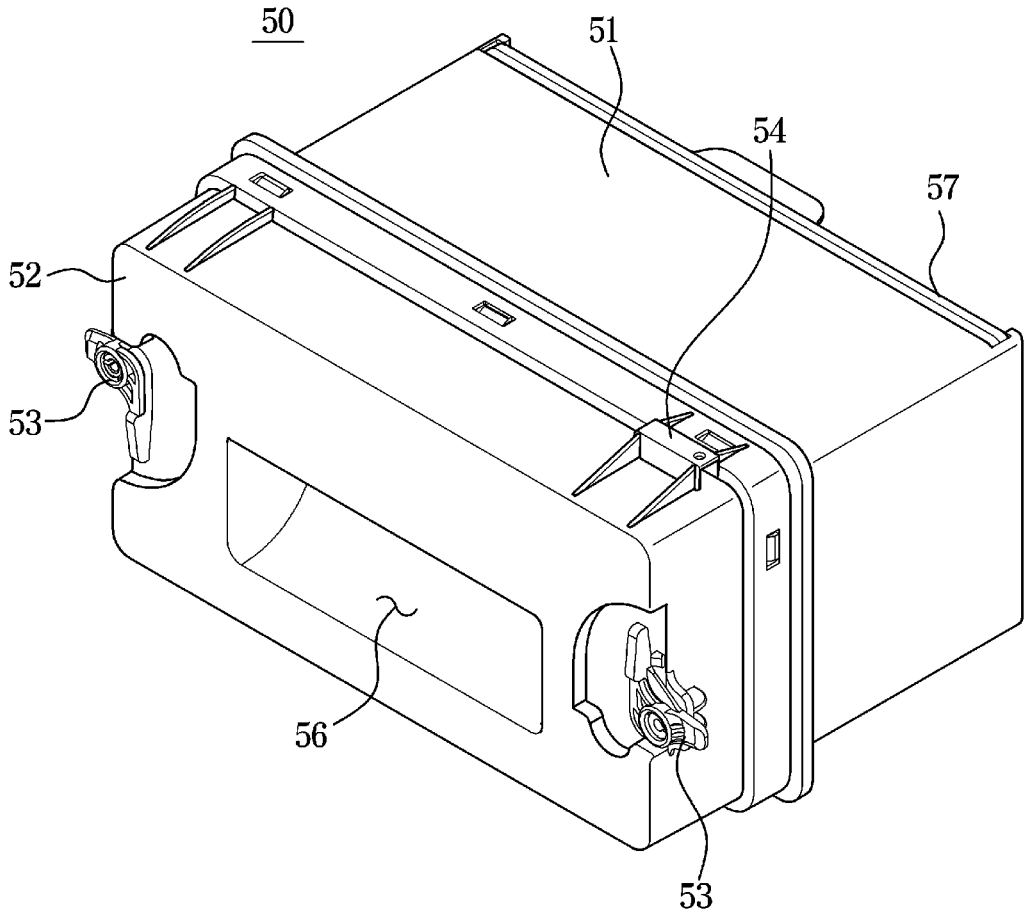
FIG. 3 is a view of the filter unit of the dryer illustrated in FIG. 2.
Figure 4:
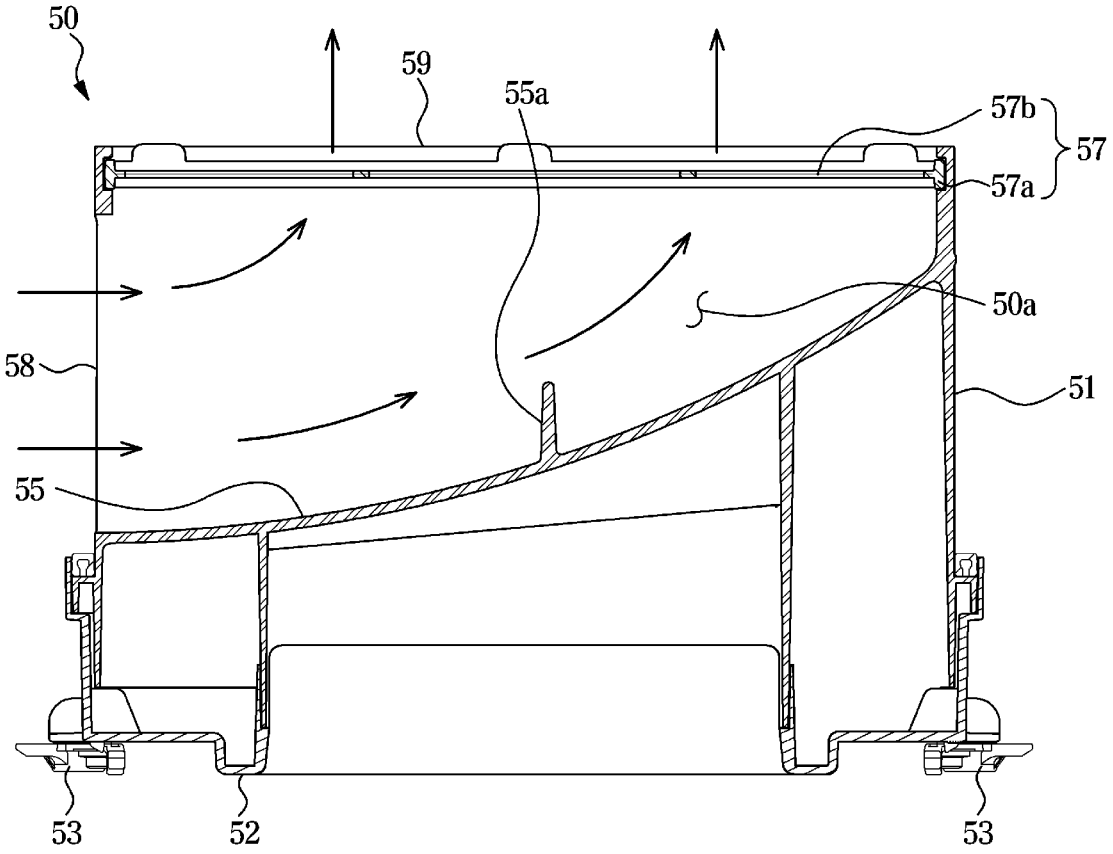
FIG. 4 is a sectional view of the filter unit illustrated in FIG. 3.

FIG. 1 is a view of a dryer according to an example embodiment of the disclosure. FIG. 2 is a vertical cross-sectional view of the dryer to which a filter unit is mounted. FIG. 3 is a view of the filter unit of the dryer illustrated in FIG. 2. FIG. 4 is a sectional view of the filter unit illustrated in FIG. 3.

Referring to FIG. 1, a direction along an X-axis may be defined as a front and rear direction, a direction along a Y-axis may be defined as a left and right direction, and a direction along a Z-axis may be defined as an up and down direction. Further, the terms "front and rear direction", "left and right direction", "up and down direction" used in the following description are defined based on the drawings, and the shape and position of each component is not limited by these terms.

Referring to FIGS. 1 and 2, the dryer 1 according to an example embodiment of the disclosure includes a cabinet 10. The cabinet 10 may include a front surface 11, an upper (top) surface 12, a first (right) side surface 13, a second (left) side surface (not visible in FIGS. 1 and 2) opposite of the first (right) side surface 13, a rear surface 14, and a lower (bottom) surface 15, and may be provided in a substantially cuboid shape. The cabinet 10 may form a main body of the dryer 1.

The cabinet 10 may be provided with a water drain tank 16. For example, the water drain tank 16 may be provided on an upper portion of the front surface 11 of the cabinet 10. The water drain tank 16 may store condensed water generated by an operation of a refrigerant cycle to be described later.

The cabinet 10 may be provided with a manipulator 17 for manipulating or controlling operations of the dryer. The manipulator 17 may also be referred to as a user interface or control panel, for example. For example, the manipulator 17 may be provided on the upper portion of the front surface 11 of the cabinet 10. The manipulator 17 as illustrated in FIG. 1 includes a rotary switch 17*a*, a display 17*b*, and a button 17*c*. The rotary switch 17*a* may be gripped and rotated by a user so as to allow the user to select a mode of the dryer 1. The display 17*b* may be provided to display an operation state of the dryer 1 and/or a user's manipulation state. The display 17*b* may be configured to receive a touch input via a touch-sensitive interface. The button 17*c* may be pressed by a user so as to allow the user to select a mode of the dryer 1. However, the disclosure is not limited to the examples of the rotary switch 17*a*, display 17*b*, and button 17*c*, and various manipulation or input methods and devices may be implemented to control operations of the dryer. For example, operations of the dryer may be controlled by voice input, wirelessly via a remote device such as a smartphone or computer, and the like. Additionally, while FIG. 1 illustrates that the manipulator 17 is provided on an upper portion of the front surface 11, the manipulator 17 may be provided at another location, for example, on the upper surface 12.

The cabinet 10 may include a base 60. The base 60 may be provided in a lower portion of the cabinet 10 to form the lower surface 15. Legs 19 provided to support the cabinet 10 may be provided on the lower surface 15.

The dryer 1 includes a drum 20 provided to accommodate an object to be dried. The drum 20 may include an entrance of the drum into which the object to be dried is placed. The drum 20 may be rotatably disposed inside the cabinet 10.

Figure 7:
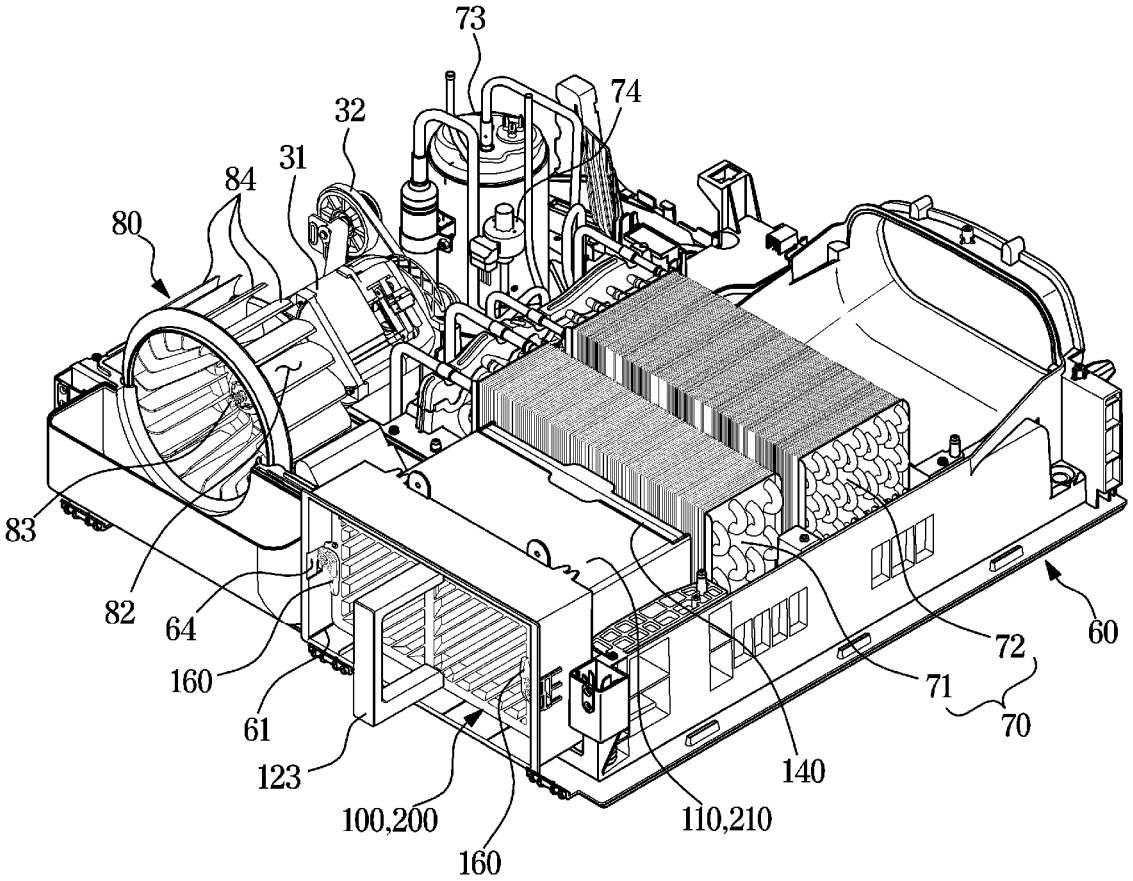
FIG. 7 is a view of a base of the dryer illustrated in FIG. 5.

The dryer 1 may include a driver configured to rotate the drum 20. Referring to FIG. 7 (and FIG. 21), the driver may include a drive motor 31 mounted on the base 60, a pulley 32 rotated by the drive motor 31, and a belt 33 provided to transmit power of the drive motor 31 to the drum 20 by connecting the pulley 32 to the drum 20.

Referring to FIG. 2, the drum 20 may include an inlet 21 through which air is introduced into an internal space 23 of drum 20 and an outlet 22 through which air is discharged from the internal space 23 of the drum 20 to the outside of the drum 20. The inlet 21 may be formed on one side of the drum 20, and the outlet 22 may be formed on the other side of the drum 20. For example, the inlet 21 may be a rear side opening of the drum 20, and the outlet 22 may be a front side opening of the drum 20. For example, the front side opening of the drum 20 may be an entrance of the drum.

High-temperature and dry air may be introduced into the drum 20 through the inlet 21 to dry an object, which is to be dried and which is accommodated in the drum 20. In addition, air containing a large amount of moisture after drying the object to be dried may be discharged from the drum 20 through the outlet 22.

A plurality of lifters 24 may be disposed inside the drum 20. The lifter 24 raises and drops the object to be dried to allow the object to come into contact with the hot air while floating or travelling in a space inside the drum 20.

A first opening (or an inlet) 25 is formed on the front side of the cabinet 10 to allow a user put an object to be dried into the drum 20, and a door 30 configured to open and close the first opening 25 may be installed thereon. The door 30 may be hinge-coupled to one side of the first opening 25 to be rotatable.

The base 60 may be disposed under the drum 20. Referring to FIG. 7, a heat exchanger 70, a compressor 73, an expansion device 74 and the like that form the refrigerant cycle may be mounted on the base 60. In addition, a fan 80, the drive motor 31, and the pulley 32 may be mounted on the base 60. A base cover 75 may be provided on an upper portion of the base 60 to cover the heat exchanger 70 and the like. For example, the base cover 75 may form a duct structure together with the base 60.

The fan 80 may be provided on the base 60. The fan 80 may generate a blowing force to form an air flow path. For example, the fan 80 may discharge air in a radial direction. For this, the fan 80 may include a rotating shaft 83 formed in a center and a plurality of blades 84 formed in a circumferential direction about the rotating shaft 83.

Figure 21:
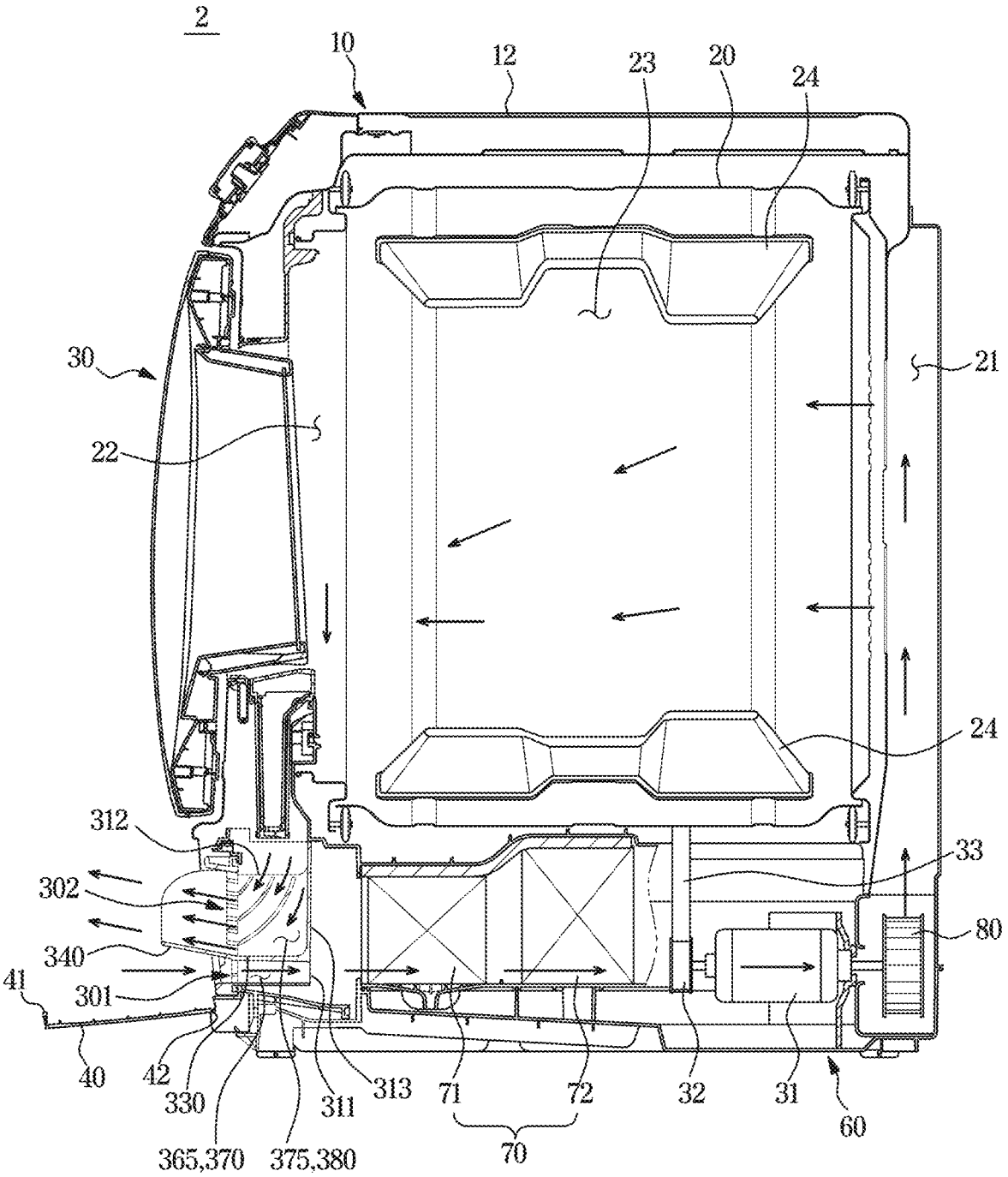
FIG. 21 is a vertical cross-sectional view of the dryer illustrated in FIG. 20.

As illustrated in FIG. 7, the fan 80 may be disposed adjacent to dehumidification units 100 and 200 to be described later. For example, the fan 80 may be disposed on a flow path connecting the drum 20 to the dehumidification units 100 and 200. For example, the fan 80 may be disposed on a flow path connecting the entrance of the drum to intake ports 112 and 212 of the dehumidification units 100 and 200 to be described later. For example, the fan 80 may be disposed in the middle of the flow path connecting the entrance of the drum to the intake ports 112 and 212 of the dehumidification units 100 and 200 (see FIGS. 11 and 17). Further, a discharge side 82 of the fan 80 may be disposed to face the intake ports 112 and 212 of the dehumidification units 100 and 200. Accordingly, air discharged from the drum 20 may be easily introduced into the dehumidification units 100 and 200 by the blowing force of the fan 80, and the introduced air may be easily discharged to the outside of the cabinet 10 through outlet flow paths 180 and 280 inside the dehumidification unit. As a result, the fan 80 may function to easily discharge the air, which is dehumidified by exchanging heat with the heat exchanger 70, to the outside of the cabinet 10. However, the disclosure is not limited thereto, and the fan 80 may be disposed at any location that allows air to flow smoothly. For example, as illustrated in FIG. 21, the fan 80 may be provided at a rear side of the heat exchanger 70 on the base 60.

Inside the cabinet 10, the refrigerant cycle for heating and condensing air may be formed. A refrigerant may circulate in a series of processes including compression-condensation-expansion-evaporation. For example, the refrigerant cycle may include the heat exchanger 70, the compressor 73, and the expansion device 74. The heat exchanger 70 exchanges heat with air, and may include an evaporator 71 and a condenser 72.

The compressor 73 compresses a refrigerant into a high-temperature and high-pressure state and discharges the high-temperature and high-pressure refrigerant, and the discharged refrigerant flows into the condenser 72. The condenser 72 may condense the compressed refrigerant and release heat to the surroundings through a condensation process. In addition, the expansion device 74 expands the high-temperature and high-pressure refrigerant condensed in the condenser 72 to a low-pressure state. The evaporator 71 may evaporate the expanded refrigerant and remove heat from the surrounding air through an evaporation process.

When an object to be dried is put into the dryer and the dryer is operated in a drying mode, high-temperature and high-humidity air discharged from the drum 20 may pass through the evaporator 71. Accordingly, the high-temperature and high-humidity air discharged from the drum 20 may be cooled while passing through the evaporator 71, and thus the high-temperature and high-humidity air may be changed to low-temperature and dry air. At this time, condensed water may be generated as the high-temperature and high-humid air is cooled in the evaporator 71. The condensed water may be moved to the water drain tank 16 or drained to the outside of the cabinet 10. Further, the low-temperature and dry air, which passed through the evaporator 71, may pass through the condenser 72. Accordingly, the low-temperature and dry air discharged from the evaporator 71 is heated while passing through the condenser 72, and thus the low-temperature and dry air may be changed into high-temperature and dry air. The high-temperature and dry air may be introduced into the drum 20 through the inlet 21 to dry the object to be dried. As the air dries the object to be dried, high-temperature and high-humidity air containing a large amount of moisture may be discharged through the outlet 22. The discharged air may pass through the evaporator 71, again. In other words, the air may dry the object, which is to be dried and which is accommodated in the drum 20, while circulating inside the cabinet 10.

In general, a closed flow path may be formed inside the cabinet 10 of the dryer 1 in the drying mode. The closed flow path may be an air movement path (refer to the arrows in FIG. 2) provided to circulate the inside air of the cabinet through the heat exchanger 70 and the drum 20. The closed flow path may not communicate with the outside of the cabinet 10 so as to prevent the outside air of the cabinet 10 from flowing in or out. That is, the flow of air may form a closed loop.

Referring to FIG. 1, the dryer 1 includes a second opening 65 provided on the front surface 11 of the cabinet 10 to access the heat exchanger 70. For example, the second opening 65 may be provided at a lower part of the front surface 11 of the cabinet 10. The dehumidification units 100 and 200 and the filter unit 50 to be described later may be mounted to the inside of the cabinet 10 through the second opening 65. For example, the dehumidification units 100 and 200 and the filter unit 50 may be detachably mounted to a unit accommodating portion 61 formed inside the cabinet 10 through the second opening 65. That is, the dehumidification units 100 and 200 or the filter unit 50 may be mounted on the unit accommodating portion 61, and the dehumidification units 100 and 200 and the filter unit 50 may be provided to be interchangeable with each other. For example, when the dehumidification unit 100 and 200 is mounted on the unit accommodating portion 61, the dryer 1 may perform a dehumidifying mode (dehumidifying operation) for dehumidifying the surrounding space. When the filter unit 50 is mounted on the unit accommodating portion 61, the dryer 1 may perform the drying mode (drying operation) for drying the object to be dried, such as clothes. Further, a unit cover 40 may be provided on the front surface of the cabinet 10 to open and close the second opening 65.

In a state in which the unit cover 40 closes the second opening 65, a front surface of the unit cover 40 and the front surface 11 of the cabinet 10 are connected to each other to form a smoothly connected surface without a step difference. For example, the front surface 11 of the cabinet 10 and the outer surface of the unit cover 40 may be flush with one another. In a state in which the filter unit 50 or the dehumidification units 100 and 200 is not mounted to the inside of the cabinet 10, a user can access the heat exchanger 70 through the second opening 65. When the dryer is used for a long time, foreign substances such as lint may be attached to the heat exchanger, and a user can remove these foreign substances through the second opening 65. Therefore, the location of the second opening 65 may serve to allow access through a single opening to the filter unit 50, dehumidification units 100 and 200, and the heat exchanger 70.

The unit cover 40 may include a coupling protrusion 41. The coupling protrusion 41 may protrude from an inner surface of the unit cover 40. The cabinet 10 may include a coupling groove 63 corresponding to the coupling protrusion 41. When the coupling protrusion 41 is coupled to the coupling groove 63, the unit cover 40 may be in a closed state. However, the disclosure is not limited thereto, and the cabinet 10 may include a coupling protrusion, and the unit cover 40 may include a coupling groove. That is, the coupling of the cabinet 10 and the unit cover 40 may be provided in various forms.

In addition, the unit cover 40 may include a coupling hinge 42 providing a rotating shaft to allow the unit cover 40 to be rotated about the cabinet 10. The coupling hinge 42 may be provided at a lower portion of the unit cover 40. The cabinet 10 may include a coupling hinge mounting portion 62 corresponding to the coupling hinge 42. The coupling hinge 42 may be rotated by being coupled to the coupling hinge mounting portion 62 and due to a rotation thereof, a space in which the dehumidification unit 100 and 200 or the filter unit 50 is mounted, that is, the unit accommodating portion 61 may be opened and closed. As illustrated in FIG. 1, the unit cover 40 is rotatable about an axis corresponding to the Y direction, where the axis passes through a lower portion of the second opening 65. However, as another example the unit cover 40 may be rotatable about an axis corresponding to the Y direction, where the axis passes through an upper portion of the second opening 65, or the unit cover 40 may be rotatable about an axis corresponding to the Z direction, where the axis passes through a left or right side of the second opening 65.

Referring to FIG. 2, the filter unit 50 may be detachably mounted to the dryer 1. For example, the filter unit 50 may be detachably mounted on the inside of the cabinet 10 through the second opening 65. The filter unit 50 may be mounted to or removed from the unit accommodating portion 61. The filter unit 50 may prevent air from escaping from the closed flow path. That is, the filter unit 50 may prevent the deterioration in the drying efficiency of the dryer 1. The filter unit 50 may be disposed on the base 60.

Referring to FIG. 3, the filter unit 50 may include a body 51. The filter unit 50 may include a front cover 52 coupled to a front side of the body 51.

The body 51 may be provided in a substantially box shape. An inlet 58 through which air is introduced and an outlet 59 through which air is discharged may be formed in the body 51 (see FIG. 4). For example, the outlet 59 may be provided on a rear side, and the inlet 58 may be provided on a lateral side. However, the disclosure is not limited thereto, and although the inlet 58 is illustrated as being provided on the left side in FIG. 4, the inlet 58 may be provided on the right side. For example, the high-temperature and high-humidity air discharged from the drum 20 may be introduced into the filter unit 50 through the inlet 58. Further, the high-temperature and high-humidity air introduced into the filter unit 50 may be discharged through the outlet 59 and moved toward the heat exchanger 70.

A partition wall 55 is provided to allow the inlet 58 to communicate with the outlet 59 and provided to form a flow path 50*a* inside the body 51. The flow path 50*a* may be a partial region of the closed flow path. A partition wall protrusion 55*a* may be formed on the partition wall 55. The partition wall protrusion 55*a* may improve the flow uniformity by adjusting a flow rate of air flowing into the heat exchanger 70. As illustrated in FIG. 4, in an example the partition wall protrusion 55*a* extends from a rear side of the partition wall 55 in a direction toward the rear side of the body 51. The partition wall protrusion 55*a* may be formed to be straight or may be curved, for example.

A filter member 57 may be provided at a rear side of the body 51 of the filter unit 50. The filter member 57 may filter out foreign substances in the air flowing into the heat exchanger 70. The filter member 57 may include a filter frame 57*a* and a filter 57*b* mounted on the filter frame 57*a*. For example, the filter 57*b* may include at least one of a wool (cloth) material, a PET material, and a steel material. That is, the filter 57*b* may include (1) a wool (cloth) material, (2) a PET material, (3) a steel material, (4) a wool (cloth) material and a PET material, (5) a wool (cloth) material and a steel material, (6) a PET material and a steel material, or (7) a wool (cloth) material, a PET material, and a steel material.

A fixing member 53 may be provided on a front surface of the front cover 52 of the filter unit 50. The fixing member 53 may fix the filter unit 50 to the dryer 1. In addition, a gripping groove 56 may be provided on the front surface of the front cover 52. The gripping groove 56 may be gripped by a user so as to allow the user to easily mount the filter unit 50 to the dryer 1 or remove the filter unit 50 from the dryer 1.

Figure 19:
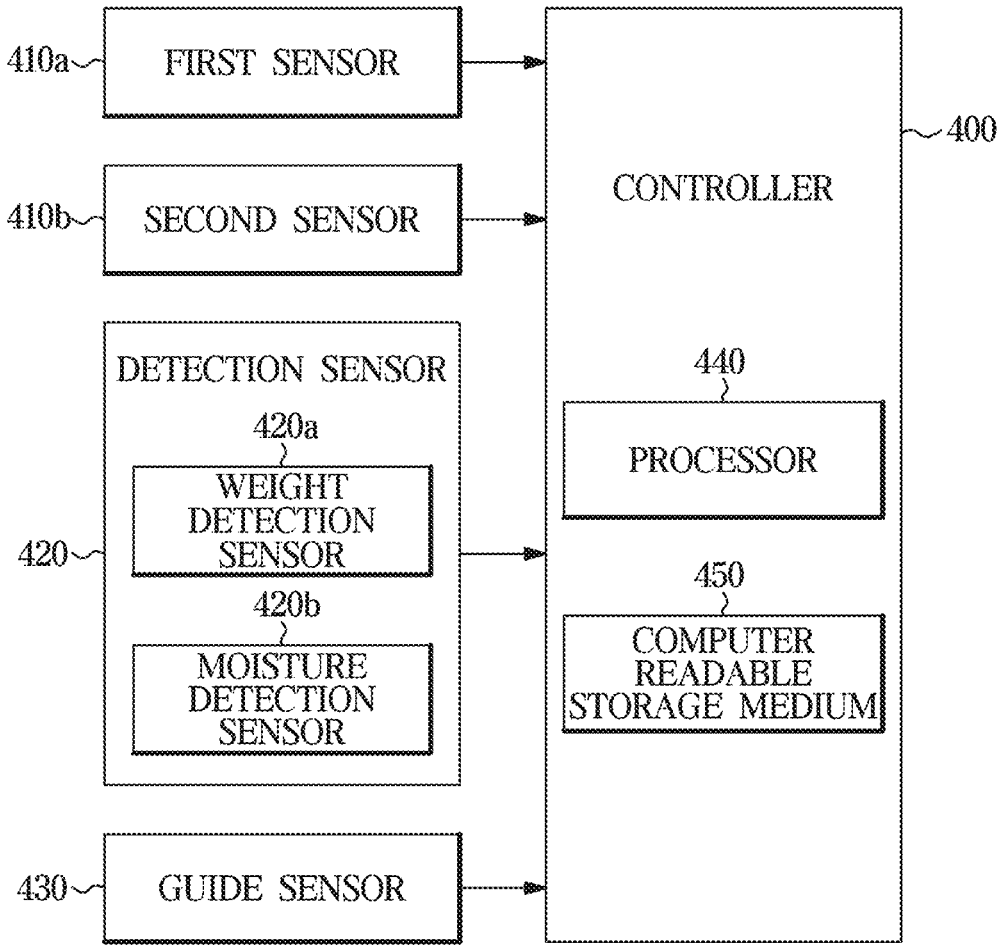
FIG. 19 is a diagram of a controller and unit sensor of the dryer according to an embodiment of the disclosure.

The filter unit 50 may be provided with a first identification portion 54. For example, the first identification portion 54 may be provided on an upper right side of the front cover 52. A first sensor 410*a* (refer to FIG. 19) configured to detect the first identification portion 54 may be provided in the dryer 1 to which the filter unit 50 is mounted. For example, the first identification portion 54 may be a magnet. Further details of the first identification portion 54 will be described later. The disclosure is not limited to the first identification portion 54 being located at the upper right side of the front cover 52. For example, the first identification portion 54 may be located at a position other than the upper right side of the front cover 52, for example, the upper left side of the front cover 52. The first identification portion 54 may be located at other positions of the filter unit 50 so long as the first identification portion 54 can be detected by the first sensor 410*a*.

When the filter unit 50 is mounted to the dryer 1 according to an example embodiment of the disclosure, the dryer 1 may perform the drying operation (drying mode). For example, when the first sensor 410*a* detects the first identification portion 54, a controller 400 may control an operation of the dryer to perform the drying mode. However, in the dryer 1 according to an example embodiment of the disclosure, the filter unit 50 may not be included in the dryer 1. In other words, even when the filter unit 50 is not mounted, the dryer 1 may perform the drying mode.

Figure 5:
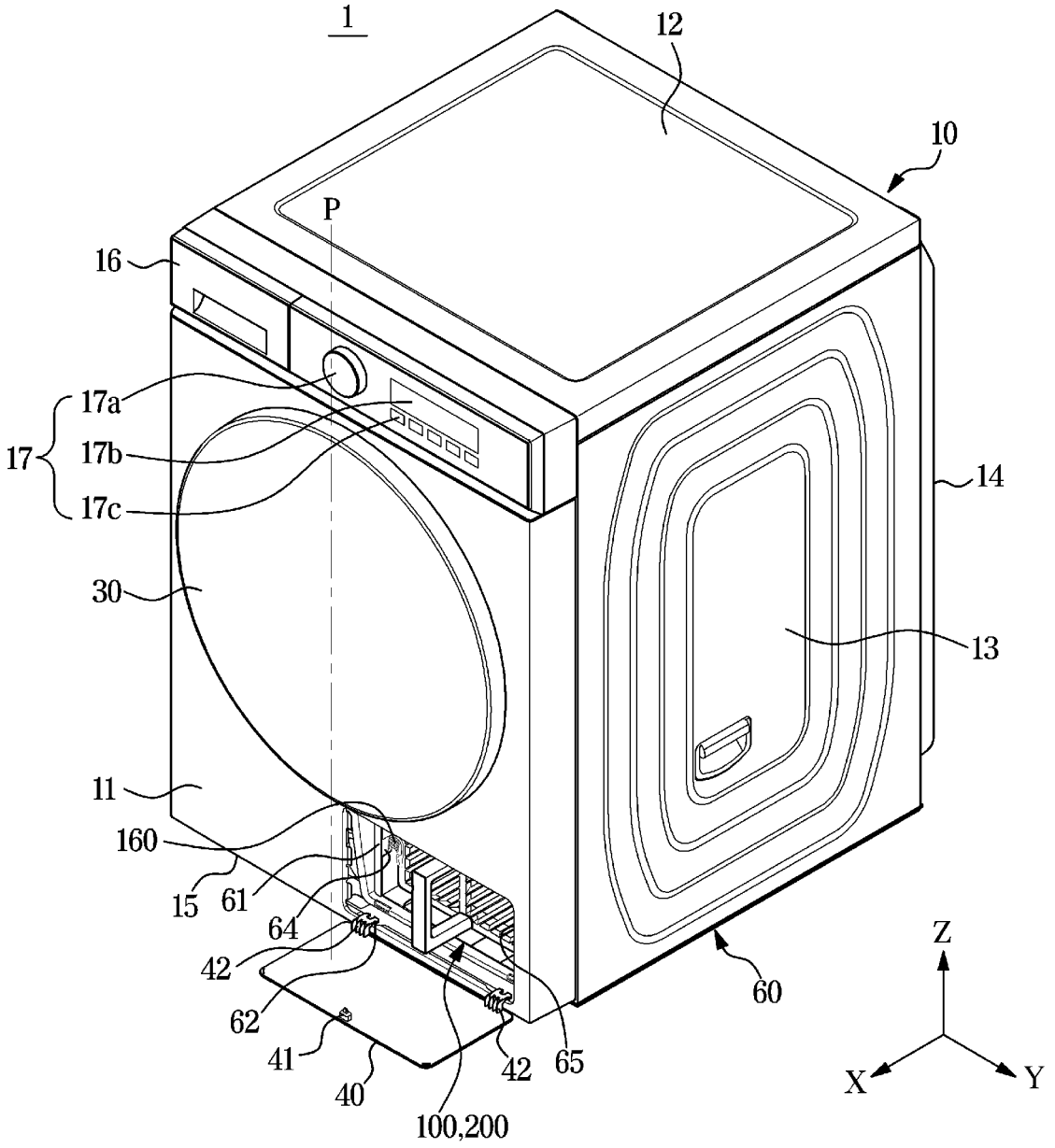
FIG. 5 is a view of a dryer to which a dehumidification unit, according to an embodiment of the disclosure, is mounted.
Figure 6:
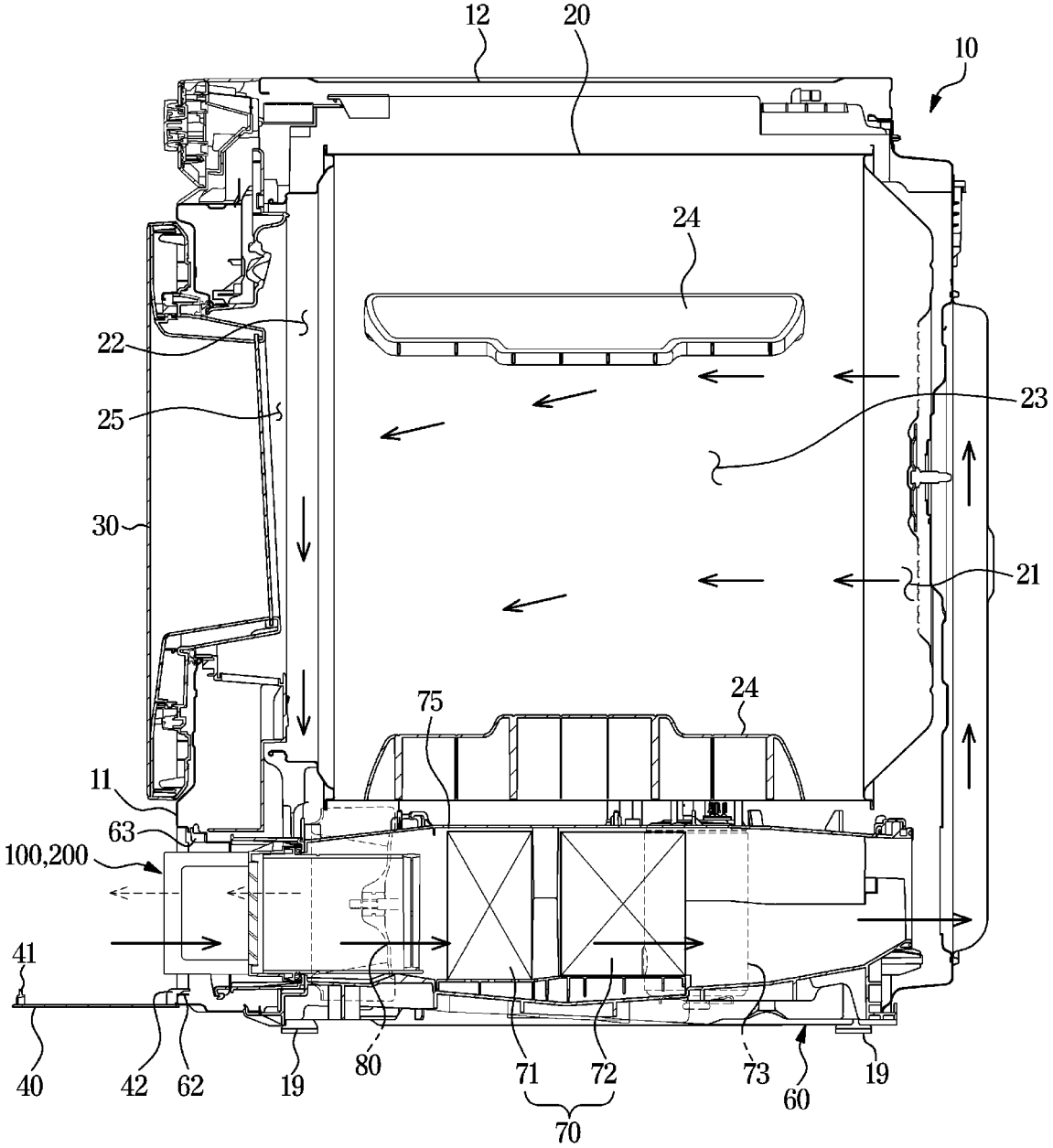
FIG. 6 is a vertical cross-sectional view of the dryer illustrated in FIG. 5.
Figure 8:
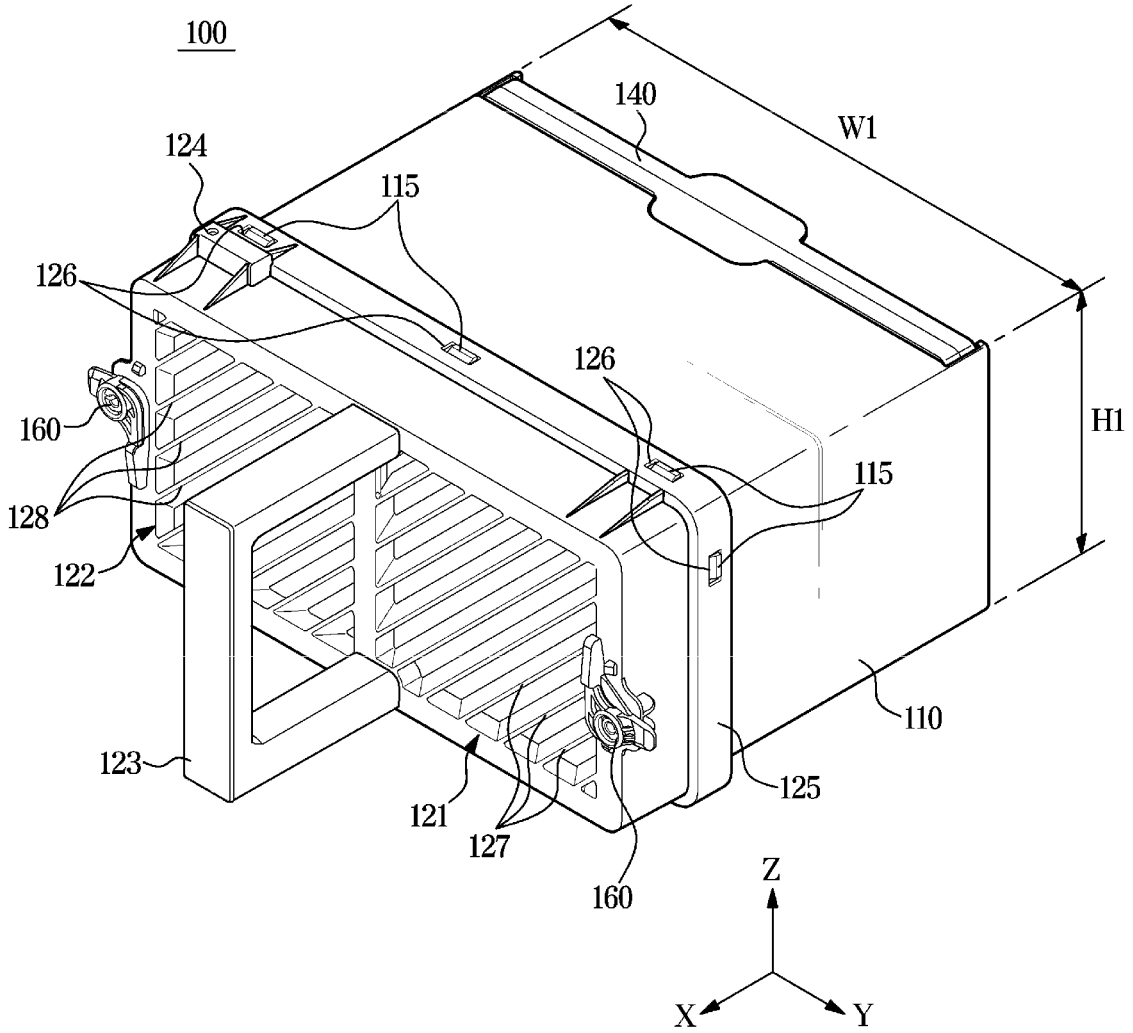
FIG. 8 is a view of the dehumidification unit illustrated in FIG. 5.
Figure 9:
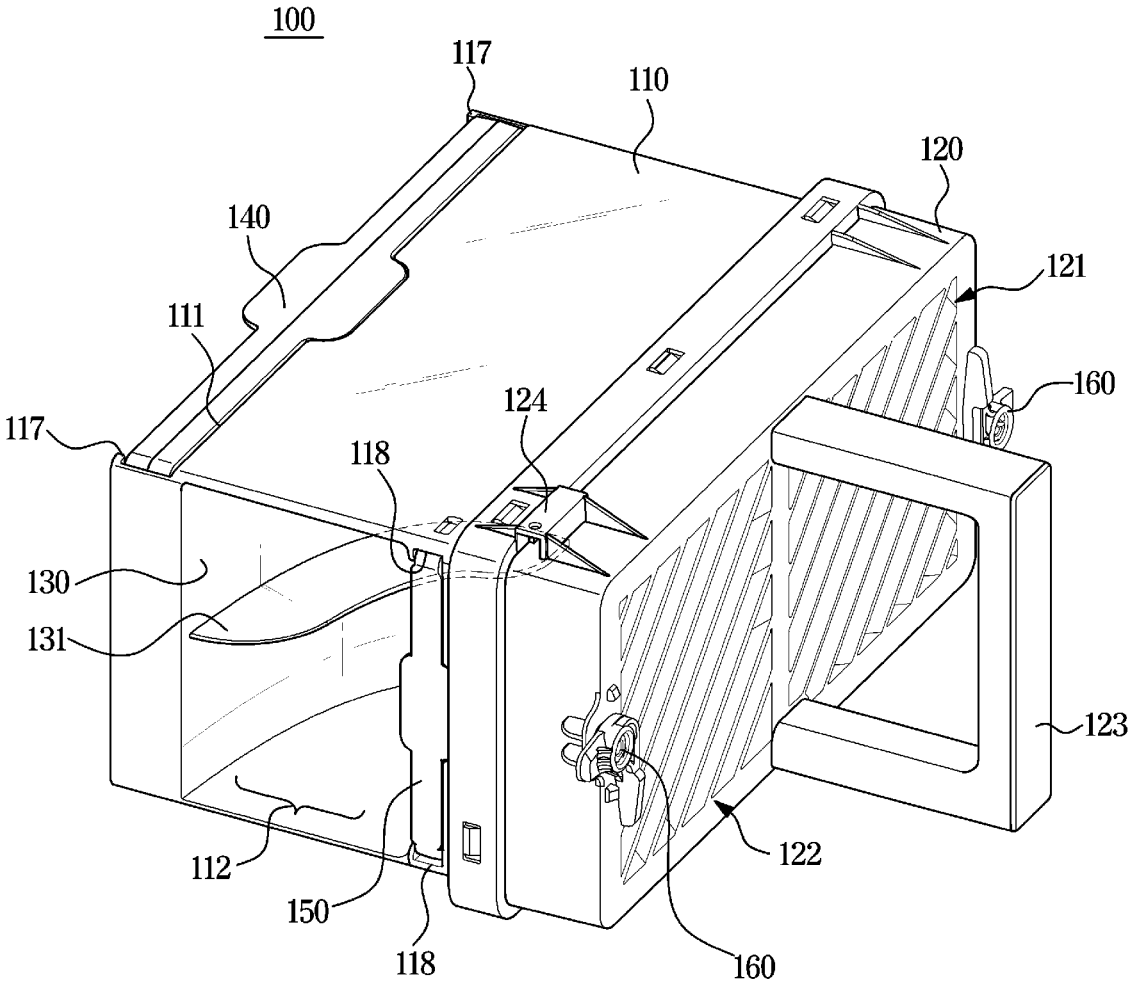
FIG. 9 is a view of the dehumidification unit illustrated in FIG. 8 when viewed from a different direction.
Figure 10:
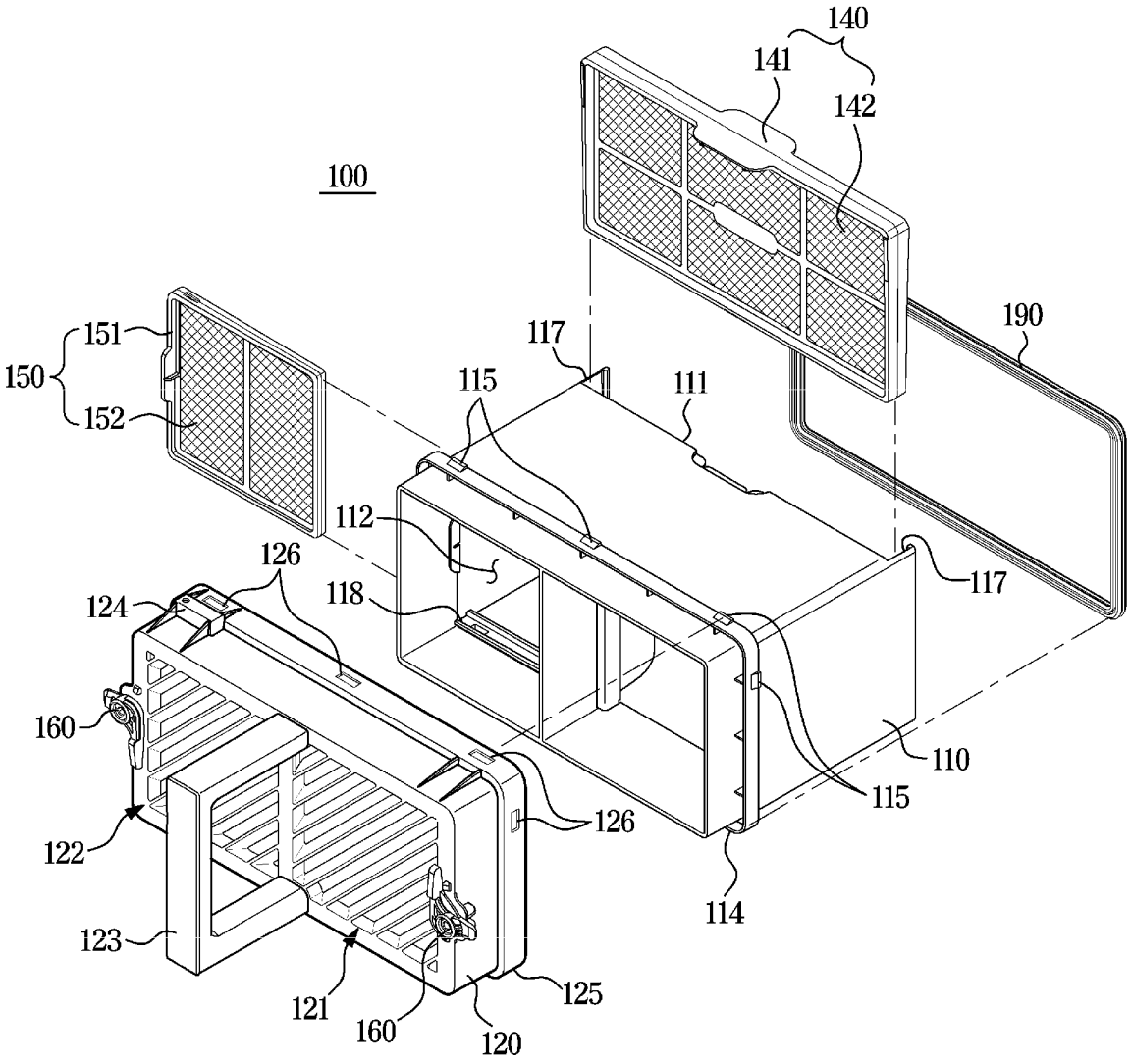
FIG. 10 is an exploded view of the dehumidification unit illustrated in FIG. 8.
Figure 11:
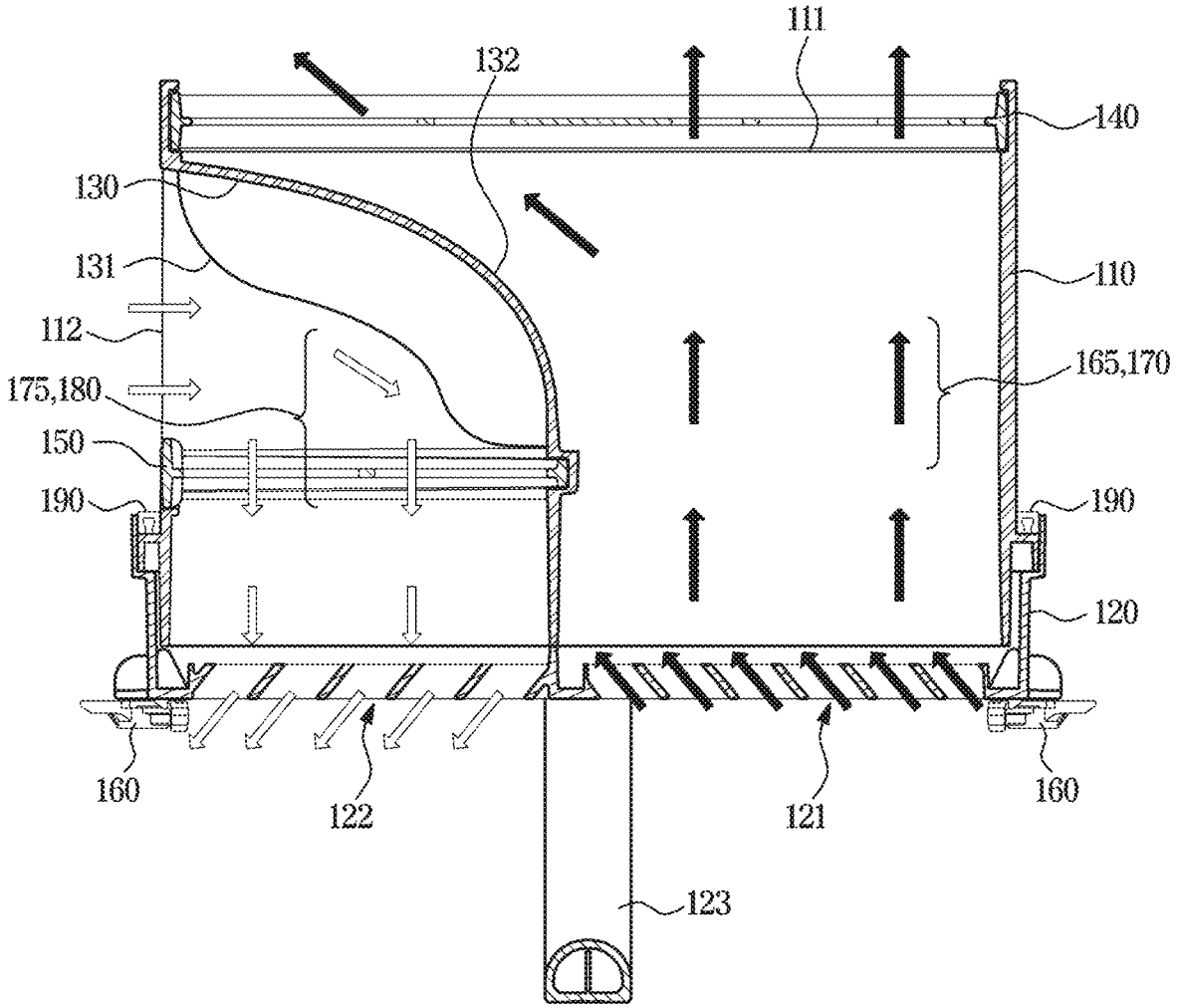
FIG. 11 is a sectional view of the dehumidification unit illustrated in FIG. 8.

FIG. 5 is a view of a dryer to which a dehumidification unit according to one embodiment of the disclosure is mounted. FIG. 6 is a vertical cross-sectional view of the dryer illustrated in FIG. 5. FIG. 7 is a view of a base of the dryer illustrated in FIG. 5. FIG. 8 is a view of the dehumidification unit illustrated in FIG. 5. FIG. 9 is a view of the dehumidification unit illustrated in FIG. 8 when viewed from different directions. FIG. 10 is an exploded view of the dehumidification unit illustrated in FIG. 8. FIG. 11 is a sectional view of the dehumidification unit illustrated in FIG. 8.

Referring to FIG. 5, the dehumidification units 100 and 200 may be detachably mounted to the dryer 1. The dehumidification units 100 and 200 may be mounted to the inside of the cabinet 10 through the second opening 65 provided in the front surface of the cabinet 10. Further, the dehumidification units 100 and 200 may be mounted in the dryer 1 instead of the filter unit 50. That is, the dehumidification unit 100 and 200 and the filter unit 50 may be provided to be interchangeable with each other. In other words, a user may mount the dehumidification units 100 and 200 or the filter unit 50 to the dryer 1 according to a function (dehumidifying mode or drying mode) to be used. For example, in a state in which the filter unit 50 is separated from the cabinet 10, the dehumidification units 100 and 200 may be detachably mounted to the unit accommodating portion 61. In addition, the dehumidification units 100 and 200 may be detachably mounted on the base 60.

As illustrated in FIGS. 6 and 7, the dehumidification units 100 and 200 may be provided on the base 60. For example, the dehumidification units 100 and 200 may be detachably mounted to the base 60.

For example, when the dehumidification unit 100 and 200 is mounted on the dryer 1, the dryer 1 may include an open flow path. The open flow path may be an air movement path (refer to the arrows in FIG. 6) in which outside air is sucked into the dryer 1, passes through the heat exchanger 70 and the drum 20, and is then discharged to the outside of the dryer 1. Alternatively, the open flow path may be an air movement path in which outside air is sucked into the dryer 1, is passed through the heat exchanger 70, and is then discharged to the outside of the dryer 1. Both ends of the open flow path (inlet port 121 and outlet port 122, illustrated in FIG. 8, to be described later) may communicate with the outside of the cabinet 10, respectively, and a flow of air may form an open loop.

Referring to FIGS. 2 and 6, when the dehumidification unit 100 and 200 is mounted to the dryer 1 after removing the filter unit 50, the closed flow path may be switched to the open flow path. Accordingly, the dryer 1 may perform a dehumidifying operation (i.e., operate in a dehumidifying mode). That is, the dryer may be switched from the drying mode to the dehumidifying mode.

Hereinafter the dehumidification unit 100 according to an example embodiment of the disclosure will be described in detail.

Referring to FIG. 8, the dehumidification unit 100 may include a body 110. The dehumidification unit 100 may include first and second chambers 165, 175. The first chamber 165 provides a first flow path 170 for air from outside the cabinet to be supplied to the heat exchanger 70 through the second opening 65. The second chamber 175 provides a second flow path 180 for air discharged from the heat exchanger 70 to be discharged through the second opening 65. The chambers may alternatively be referred to as compartments or partitioned spaces. The body 110 may be provided in a substantially box shape. The dehumidification unit 100 includes an inlet port 121 and an outlet port 122. The inlet port 121 and the outlet port 122 may be provided on a front side of the body 110. The inlet port 121 is provided to introduce air from the outside of the cabinet 10 through the second opening 65 into the first chamber 165. The outlet port 122 is provided to allow the air to be discharged from the second chamber 175 to the outside of the cabinet 10 through the second opening 65. For example, the outside high-humid air may be sucked into the dryer 1 through the inlet port 121, and high-temperature and dry air may be discharged from the inside of the dryer 1 to the outside of the dryer 1 through the outlet port 122.

The outlet port 122 may be disposed on a lateral or adjacent side of the inlet port 121. For example, the inlet port 121 and the outlet port 122 may be disposed side by side in the left and right direction. The inlet port 121 and the outlet port 122 may be located on the same plane (e.g., Y-Z plane in FIG. 8). According to the disclosure, when viewed toward the front surface of the dryer 1, the outlet port 122 may be disposed on the left side and the inlet port 121 may be disposed on the right side. This arrangement structure is determined depending on which side the heat exchanger 70 is positioned with respect to the drum 20 of the dryer 1, and as illustrated in FIG. 5, in a structure in which the heat exchanger 70 is disposed on the right side of the drum 20 when viewed toward the front surface of the dryer 1, the outlet port 122 may be disposed close to the drum 20 and the inlet port 121 may be disposed far from the drum 20, and thus it is possible to simplify the flow path. In other words, in order to facilitate the flow of air discharged from the drum 20, it may be appropriate that the outlet port 122 is disposed close to the center of the dryer 1 and the inlet port 121 is disposed close to the lateral side of the dryer 1. That is, as illustrated in FIG. 5, with respect to a vertical line P passing through the center of the first opening 25, the outlet port 122 may be disposed closer to the vertical line P than the inlet port 121.

In the disclosure, the dehumidification unit 100 is formed in a cuboid shape with a wide width W1 and a low height H1. That is, the width W1 may be greater than the height H1, and thus it is efficient to divide the width W1 into halves and form the inlet port 121 and the outlet port 122, respectively. That is, an area occupied by the inlet port 121 and an area occupied by the outlet port 122 on the front surface of the dehumidification unit 100 may be approximately the same and thus a flow rate of the inflow air and a flow rate of the exhaust air may be equal.

A discharge port 111 may be provided at a first side of the body 110 of the dehumidification unit 100. For example, the discharge port 111 may be formed on a rear side of the body 110 which faces in a direction toward the heat exchanger 70. The discharge port 111 may guide the outside air, which is introduced through the inlet port 121, to the heat exchanger 70. That is, the discharge port 111 may communicate with the inlet port 121. The heat exchanger 70 may be disposed at a rear side of the discharge port 111, and the discharge port 111 may be disposed to face the heat exchanger 70. The introduced outside air may be air in a state before dehumidification, and the air may be high-humid air (i.e., air having a high humidity).

The intake port 112 may be provided at a second side of the body 110 of the dehumidification unit 100. For example, the intake port 112 may be formed on the lateral side of the body 110. FIGS. 9 to 11 illustrate that the intake port 112 is formed on the left side of the body 110, but the disclosure is not limited thereto. For example, by changing the air flow path, the base structure and the like, the intake port 112 may be formed on the right side of the body 110. According to the disclosure, in a structure in which the dehumidification unit 100 is disposed on the right side of the drum 20, a smooth flow path may be formed by providing the intake port 112 on the left side of the dehumidification unit 100. The intake port 112 may communicate with the outlet port 122 to allow air, which is discharged from the drum 20, to be discharged to the outside through the outlet port 122. The air discharged from the drum 20 may be air that is dehumidified and heated by passing through the heat exchanger 70, and thus high-temperature and dry air may be discharged through the drum 20. In detail, in a state in which the dryer 1 according to the disclosure is operated in the dehumidifying mode, it is appropriate that the inside of the drum 20 is empty. Therefore, there is practically no change in humidity of the high-temperature and dry air, which is introduced into the rear side of the drum 20, in the process of being discharged through the entrance of the drum 20.

The dehumidification unit 100 may further include at least one of a suction filter 140 and an exhaust filter 150. That is, the dehumidification unit 100 may include the suction filter 140, the exhaust filter 150, or both the suction filter 140 and the exhaust filter 150. For example, the suction filter 140 and the exhaust filter 150 may be detachably mounted on the body 110 of the dehumidification unit 100. The suction filter 140 may filter out foreign substances flowing into the dehumidification unit 100, and the exhaust filter 150 may filter out foreign substances to be discharged to the outside of the dryer 1.

The suction filter 140 may be provided on a rear side (to the rear) of the inlet port 121. For example, the suction filter 140 may be provided in the discharge port 111. The suction filter 140 may be detachably mounted to the body 110. A filter rail 117 provided to mount the suction filter 140 may be provided on the body 110. The suction filter 140 may include a filter frame 141 and a filter 142 mounted on the filter frame 141. The suction filter 140 may filter out foreign substances in the air introduced from the outside of the cabinet 10 through the inlet port 121. Accordingly, in a state in which outside air is introduced, it is possible to prevent foreign substances from entering the heat exchanger 70. For example, the filter 142 may include at least one of a wool (cloth) material, a PET material, and a steel material. That is, the filter 142 may include (1) a wool (cloth) material, (2) a PET material, (3) a steel material, (4) a wool (cloth) material and a PET material, (5) a wool (cloth) material and a steel material, (6) a PET material and a steel material, or (7) a wool (cloth) material, a PET material, and a steel material.

The exhaust filter 150 may be provided at a rear side (to the rear) of the outlet port 122. For example, the exhaust filter 150 may be provided on the outlet flow path 180 to be described later. The exhaust filter 150 may be detachably mounted to the body 110. A filter rail 118 provided to mount the exhaust filter 150 may be provided on the body 110. The exhaust filter 150 may include a filter frame 151 and a filter 152 mounted on the filter frame 151. The exhaust filter 150 may filter out foreign substances in air received into the body 110 through the intake port 112. Accordingly, in a state in which the air is discharged to the outside, it is possible to prevent foreign substances from being discharged to the outside. For example, the filter 152 may include at least one of a wool (cloth) material, a PET material, and a steel material. That is, the filter 152 may include (1) a wool (cloth) material, (2) a PET material, (3) a steel material, (4) a wool (cloth) material and a PET material, (5) a wool (cloth) material and a steel material, (6) a PET material and a steel material, or (7) a wool (cloth) material, a PET material, and a steel material.

The dehumidification unit 100 includes a guide 130, also referred as a wall portion or partition, provided inside the body 110. Referring to FIG. 11, the guide 130 may partition the inside of the body 110 into the first and second chambers 165, 175 which respectively provide an inlet flow path 170 and the outlet flow path 180.

The inlet flow path 170 extends from the inlet port 121 to the discharge port 111. That is, the inlet flow path 170 is a passage through which the discharge port 111 and the inlet port 121 communicate with each other in the body 110. Air introduced into the body 110 through the inlet port 121 is supplied to the heat exchanger 70 through the discharge port 111 along the inlet flow path 170. That is, the air before dehumidification may be delivered to the heat exchanger 70 along the inlet flow path 170.

The outlet flow path 180 extends from the intake port 112 to the outlet port 122. That is, the outlet flow path 180 is a passage through which the intake port 112 and the outlet port 122 communicate with each other in the body 110. Air introduced into the body 110 through the intake port 112 is moved to the outside of the cabinet 10 through the outlet port 122 along the outlet flow path 180. That is, the dehumidified air, which is dried by passing through the heat exchanger 70, may be discharged to the outside of the cabinet 10 along the outlet flow path 180.

Meanwhile, the guide 130 may include a curved portion 132. The guide 130 may be partially curved to allow the inlet flow path 170 and the outlet flow path 180 to provide a smooth air flow. For example, referring to FIG. 11, the curved portion 132 may form a curved section on the outlet flow path 180. The guide 130 may be curved such that the inlet flow path 170 extends toward the rear side of the body 110. That is, a width of the inlet flow path 170 may increase in a front to rear direction of the body 110. For example, the width of the inlet flow path 170 may be equal to or correspond to a width of the body 110 at a rear side of the body 110, as the curved portion 132 curves away in a direction toward the intake port 112. However, the disclosure is not limited thereto, and the curved portion 132 may be curved more sharply or less sharply, for example. Because the guide 130 includes the curved portion 132, air may be smoothly introduced or discharged.

Further, as illustrated in FIGS. 9 and 11, the guide 130 may include at least one discharge rib 131 provided on the outlet flow path 180. For example, the discharge rib 131 may be formed to protrude horizontally from the guide 130. Accordingly, the discharge rib 131 may at least partially divide the outlet flow path 180 into upper and lower regions. That is, the discharge rib 131 may extend horizontally across the outlet flow path 180 partially (e.g., as shown in FIGS. 9 and 11) or may extend horizontally across the outlet flow path 180 to fully divide the outlet flow path 180 into upper and lower regions. The discharge rib 131 may guide the air, which is received into the inside of the body 110 through the intake port 112, to the outlet port 122. That is, the discharge rib 131 may allow the dehumidified air to be easily discharged to the outside. As illustrated in FIG. 11, the discharge rib 131 is disposed on one side of the exhaust filter 150, that is, between the intake port 112 and the exhaust filter 150.

For example, the discharge rib 131 may have be in the form of a shelf that protrudes from a side surface of the guide 130, such that an inner side of the discharge rib 131 facing the guide 130 has a same curvature as the guide 130. An outer side of the discharge rib 131 facing away from the guide 130 may also be curved. A thickness or height of the discharge rib 131 in the vertical direction of the body 110 may be less than a width of the discharge rib 131 which extends along the guide 130. As an example, a plurality of discharge ribs 131 may be disposed to protrude from the guide 130. For example, the plurality of discharge ribs 131 may be stacked vertically and spaced apart from one another.

For example, the discharge rib 131 may prevent a vortex that may be generated in the outlet flow path 180. For example, in a state in which the exhaust filter 150 is provided on the outlet flow path 180, a direction of air moving toward the outlet port 122 along the outlet flow path 180 may be changed to the side of the intake port 112 by the resistance of the exhaust filter 150. That is, as the vortex is generated, there may be a difficulty in that the dehumidified air is not smoothly discharged. To alleviate the difficulty, the discharge rib 131 may effectively guide the air, which is introduced into the body 110 from the intake port 112, toward the outlet port 122, thereby preventing the vortex. As a result, because the dehumidified air is smoothly discharged, dehumidification efficiency may be improved.

For example, a description of the flow of air with reference to FIGS. 6 and 11 is as follows. Outside high-humid air, that is, air before dehumidification, may be introduced into the body 110 of the dehumidification unit 100 through the inlet port 121. The introduced air passes through the discharge port 111 along the inlet flow path 170 provided in the body 110. The air that passed through the discharge port 111 passes through the heat exchanger 70. For example, the air which passes through the discharge port 111 exchanges heat with the evaporator 71 and the condenser 72 while passing through the evaporator 71 and the condenser 72. Accordingly, the air which passes through the heat exchanger 70 becomes high-temperature and dry air. The term 'high-temperature' means a relatively higher temperature than the air before passing through the heat exchanger 70, and does not mean that it is absolutely hot. Therefore, the air which has passed through the heat exchanger 70 may have a higher temperature than the air which has passed through the discharge port 111 but has not passed through the heat exchanger 70. Likewise, the air which has passed through the heat exchanger 70 may have a lower humidity or be drier than the air which has passed through the discharge port 111 but has not passed through the heat exchanger 70. Air from which moisture is removed through the heat exchanger 70 passes through the inlet 21 of the drum 20, the internal space 23 of the drum 20 and the outlet 22, and then be introduced into the inside of the body 110 of the dehumidification unit 100 through the intake port 112 of the dehumidification unit 100. For example, the fan 80 may be disposed in the flow path connecting the outlet 22 of the drum 20 to the intake port 112 of the dehumidification unit 110. The fan 80 may allow the dehumidified air to move smoothly. The air introduced into the body 110 is discharged to the outside of the cabinet 10 through the outlet port 122 along the outlet flow path 180. Accordingly, air before dehumidification is introduced from the outside of the dryer 1 and dehumidified by exchanging heat with the heat exchanger 70, and then the dehumidified air is discharged to the outside of the dryer 1. By the flow of air, the dehumidifying operation (i.e., a dehumidifying mode) may be performed.

Figure 12:
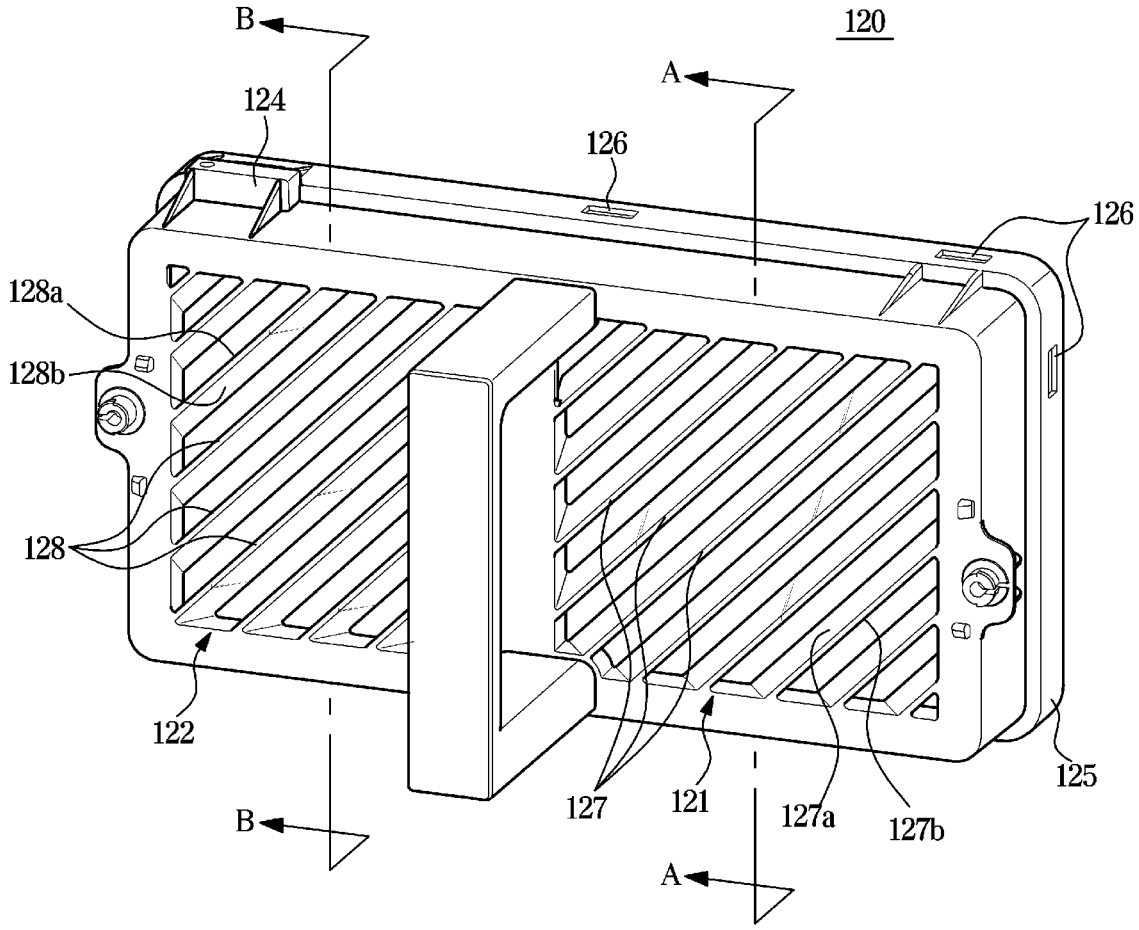
FIG. 12 is a view of a front cover of the dehumidification unit illustrated in FIG. 8.
Figure 13:
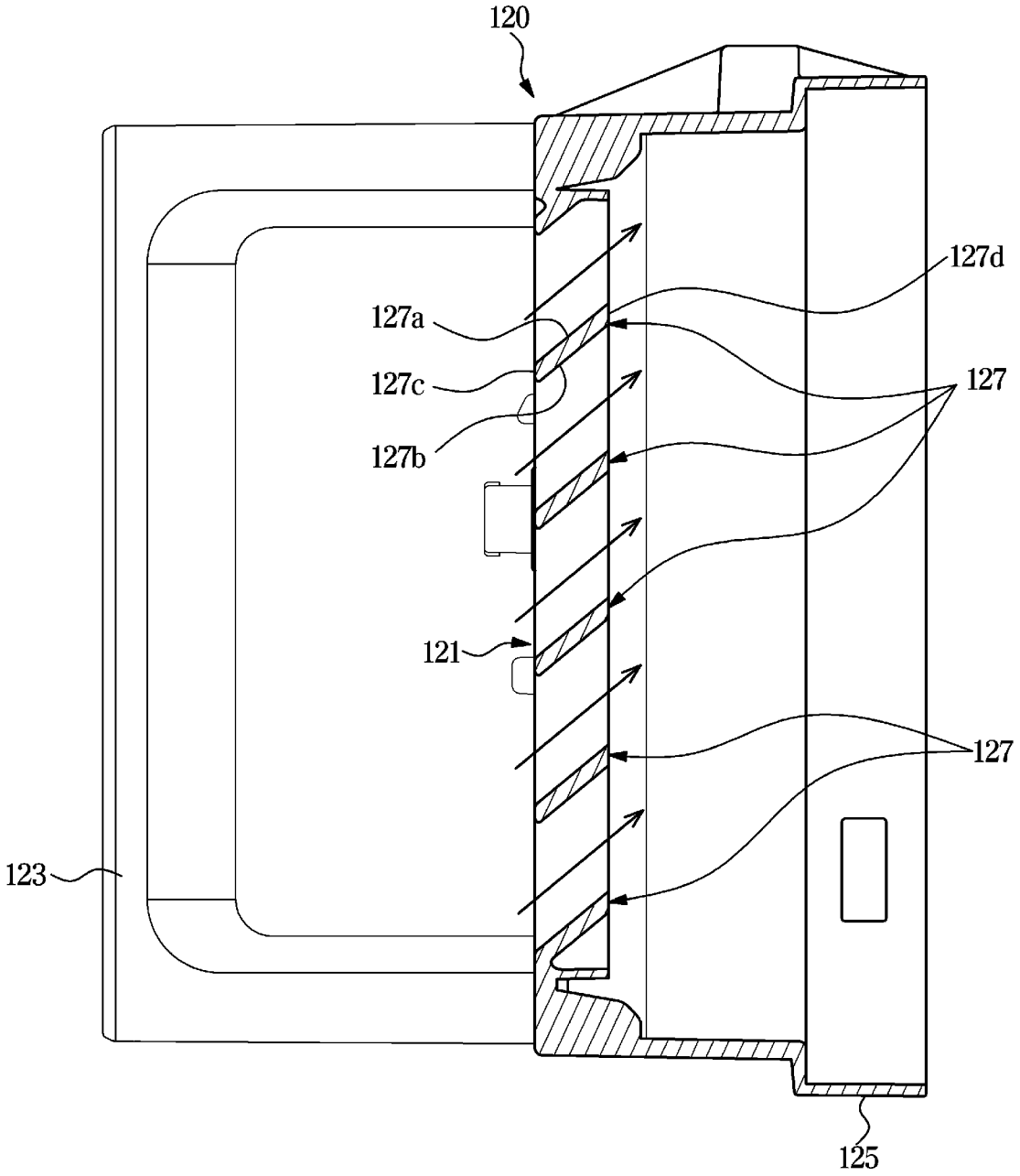
FIG. 13 is a sectional view of the front cover taken along line A-A of FIG. 12.
Figure 14:
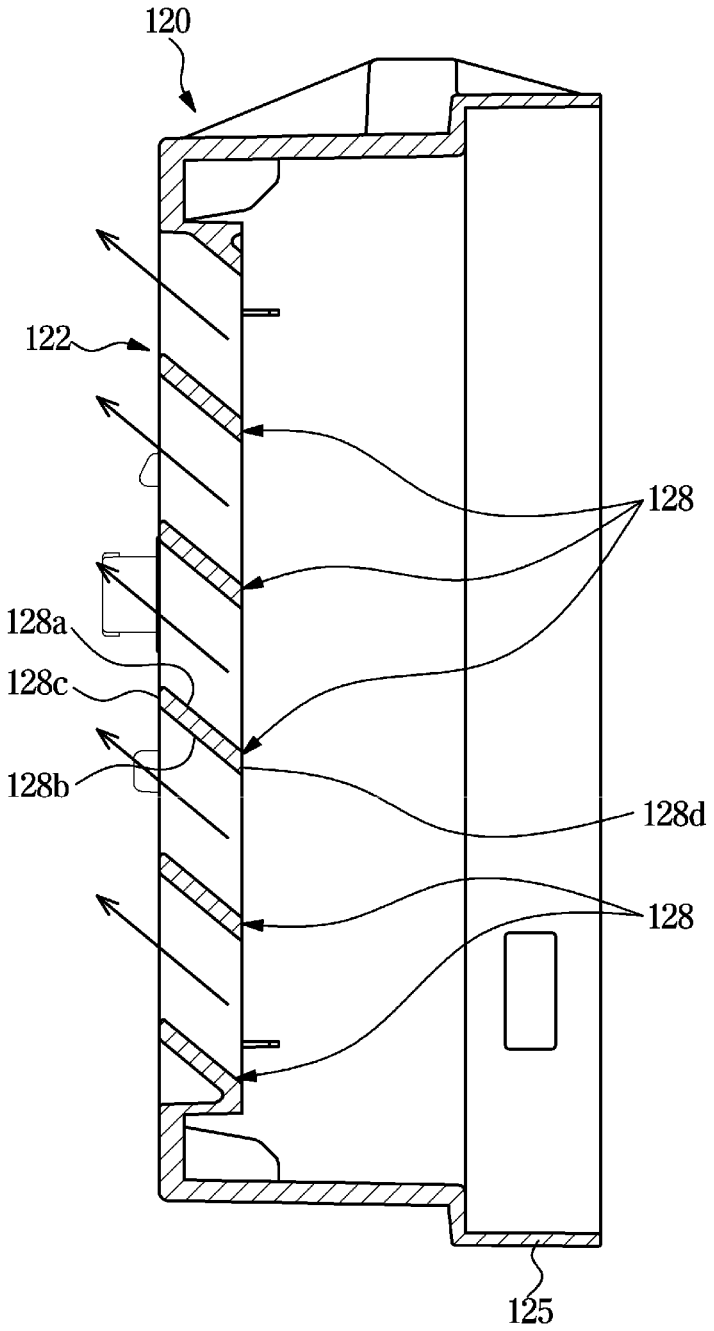
FIG. 14 is a sectional view of the front cover taken along line B-B of FIG. 12.

FIG. 12 is a view of a front cover of the dehumidification unit illustrated in FIG. 8. FIG. 13 is a sectional view of the front cover taken along line A-A of FIG. 12. FIG. 14 is a sectional view of the front cover taken along line B-B of FIG. 12.

The dehumidification unit 100 includes the inlet port 121 provided on the front side of the front cover 120 to allow air to be introduced through the second opening 65, and the outlet port 122 provided on the front side of the front cover 120 to allow the air, which is introduced through the intake port 112, to be discharged through the second opening 65.

The front cover 120 may be coupled to the front side of the body 110 of the dehumidification unit 100. The inlet port 121 and the outlet port 122 may be formed on the front cover 120. The front cover 120 may provide an orientation to the air before and after dehumidification. That is, air introduced through the inlet port 121 (air before dehumidification) and air discharged through the outlet port 122 (air after dehumidification) may not be mixed with each other. Accordingly, dehumidification efficiency may be improved.

Hereinafter examples for providing the orientation to the air before and after dehumidification will be described.

For example, the inlet port 121 may include a plurality of inlet guide ribs 127 provided to guide air in a first direction. For example, the first direction may be in a rear to upper diagonal direction (refer to FIG. 13). In addition, when viewed from the front of the dehumidification unit, the plurality of inlet guide ribs 127 may extend diagonally in the inlet port 121 to introduce air from a lower right direction. Among the plurality of inlet guide ribs 127, inlet guide ribs adjacent to each other may be spaced apart from each other by a predetermined distance and arranged in parallel. Each of the plurality of inlet guide ribs 127 may include a first surface 127*a* facing upward, a second surface 127*b* facing downward, a third surface 127*c* facing forward, and a fourth surface 127*d* facing rearward. When viewed from the front, the first surface 127*a* may be inclined to be more exposed than the second surface 127*b*. When viewed from the lateral side (e.g., line A-A), the third surface 127*c* may be inclined to be positioned lower than the fourth surface 127*d*.

Further, the outlet port 122 may include a plurality of outlet guide ribs 128 provided to guide air in a second direction. The second direction may be different from the first direction. For example, the second direction may be in a front to upper diagonal direction (refer to FIG. 14). In addition, when viewed from the front of the dehumidification unit, the plurality of outlet guide ribs 128 may extend diagonally in the outlet port 122 to discharge air to an upper left direction. Among the plurality of outlet guide ribs 128, outlet guide ribs adjacent to each other may be spaced apart from each other by a predetermined distance and disposed in parallel. Each of the plurality of outlet guide ribs 128 may include a first surface 128*a* facing upward, a second surface 128*b* facing downward, a third surface 128*c* facing forward, and a fourth surface 128*d* facing rearward. When viewed from the front, the second surface 128*b* may be inclined to be more exposed than the first surface 128*a*. When viewed from the lateral side (e.g., line B-B), the fourth surface 128*d* may be inclined to be positioned lower than the third surface 128*c*.

However, the shapes of the plurality of inlet guide ribs 127 and the plurality of outlet guide ribs 128 are not limited thereto, and may include various shapes. Alternatively, the shapes of the plurality of inlet guide ribs 127 and the plurality of outlet guide ribs 128 may be opposite to each other, which is different from those shown in the drawings.

The front cover 120 may further include a protrusion 123. As illustrated in FIGS. 5 and 6, in response to that the dehumidification unit 100 is mounted, the protrusion 123 may protrude more than (beyond) the front surface 11 of the cabinet 10. Accordingly, the unit cover 40 of the dryer 1 is not closed, and a user visually identifies the protrusion 123 while the unit cover 40 is open. Therefore, the user may intuitively recognize a state in which the dehumidification unit 100 is mounted to the dryer 1. In other words, it is possible to prevent an accident in that a user tries to operate the dryer 1 in the drying mode instead of the dehumidifying mode in a state in which the dehumidification unit 100 is mounted.

The protrusion 123 may be used for a user to grip the dehumidification unit 100. For example, the user can easily mount or remove the dehumidification unit 100 to or from the dryer 1 while holding the protrusion 123. That is, the protrusion 123 may serve as a kind of handle that can be gripped by a user. As another example, the protrusion 123 may not be included and the front cover 120 itself may protrude beyond the front surface of the cabinet 10 such that the unit cover 40 of the dryer 1 may not be closed when the dehumidification unit 100 is mounted to the dryer 1. For example, the front cover 120 may include a recess or indentation for a user to grip the dehumidification unit 100 to install or remove the dehumidification unit 100. As another example, the protrusion 123 may not be included and the guide 130 itself may protrude beyond the front surface of the cabinet 10 such that the unit cover 40 of the dryer 1 may not be closed when the dehumidification unit 100 is mounted to the dryer 1. For example, the guide 130 may include a recess or indentation for a user to grip the dehumidification unit 100 to install or remove the dehumidification unit 100.

The protrusion 123 may be disposed between the inlet port 121 and the outlet port 122 so as to function as a handle. However, the disclosure is not limited to this position and the protrusion 123 may be at other positions on the front portion of the dehumidification unit 100. Additionally, the shape of the protrusion 123 may be different, for example, the protrusion 123 may have a curved shape instead of the rectangular shape shown in FIG. 12.

At least one fixer 160 may be provided on the front surface of the front cover 120. The fixer 160 may fix the dehumidification unit 100 to the dryer 1. For example, a fixing groove 64 corresponding to the fixer 160 may be formed inside the cabinet 10. When the fixer 160 is fitted into the fixing groove 64, the dehumidification unit 100 may be firmly fixed to the dryer 1.

The front cover 120 may include a cover mounting portion 125 to be coupled to the body 110. The cover mounting portion 125 may be provided at the rear side of the front cover 120. The body 110 may include a body mounting portion 114 to be coupled to the front cover 120. The body mounting portion 114 may be provided in the front side of the body 110. A plurality of mounting protrusions 115 may be formed in the body mounting portion 114, and a plurality of mounting holes 126 corresponding to the plurality of mounting protrusions 115 may be formed in the cover mounting portion 125 (see FIG. 10). When the body mounting portion 114 is coupled to the cover mounting portion 125, the mounting protrusion 115 may be seated in the mounting hole 126.

Further, the dehumidification unit 100 may include a sealing member 190. The sealing member 190 may be provided between the body 110 and the front cover 120. In detail, as illustrated in FIG. 11, the sealing member 190 may be provided between an outer surface of the body 110 and an inner surface of the front cover 120. The sealing member 190 may serve to seal the body 110 to prevent air which flows inside the body 110 from leaking.

The dryer 1 may further include a unit sensor configured to detect the filter unit 50 or the dehumidification unit 100. For example, the unit sensor may include a first sensor 410*a* configured to detect the filter unit 50 and a second sensor 410*b* configured to detect the dehumidification unit 100 (refer to FIG. 19).

The filter unit 50 may include the first identification portion 54. The first identification portion 54 may be provided on the front cover 52. The dehumidification unit 100 may include a second identification portion 124. The second identification portion 124 may be provided on the front cover 120. For example, the first identification portion 54 and the second identification portion 124 may be a magnet. However, the disclosure is not so limited and other methods for identifying or distinguishing between the dehumidification unit 100 and the filter unit 50 may be implemented. For example, the first identification portion 54 and the second identification portion 124 may be in the form of a respective bar code which is associated with the dehumidification unit 100 and the filter unit 50. The bar codes can be read by the first sensor 410*a* and/or the second sensor 410*b*, which may be image sensors, and the controller 400 may determine whether the dehumidification unit 100 or the filter unit 50 is installed based on information (e.g., a signal) received from the first sensor 410*a* and/or the second sensor 410*b*. For example, the first identification portion 54 and the second identification portion 124 may be in the form of a respective pattern which is associated with the dehumidification unit 100 and the filter unit 50. The patterns can be identified or captured by the first sensor 410*a* and/or the second sensor 410*b*, which may be image sensors, and the controller 400 may determine whether the dehumidification unit 100 or the filter unit 50 is installed based on information (e.g., a signal) received from the first sensor 410*a* and/or the second sensor 410*b*. The first sensor 410*a* may be located so as to correspond to the first identification portion 54, and the second sensor 410*b* may be located so as to correspond to the second identification portion 124. In another example, the dehumidification unit 100 may include two identification portions and the filter unit 50 may include one identification portion. In response to the first sensor 410*a* and the second sensor 410*b* detecting both identification portions, the controller 400 may determine that the dehumidification unit 100 is installed, and in response to one of the first sensor 410*a* and the second sensor 410*b* detecting a single identification portion, the controller 400 may determine that the filter unit 50 is installed. In another example, the filter unit 50 may include two identification portions and the dehumidification unit 100 may include one identification portion. In response to the first sensor 410*a* and the second sensor 410*b* detecting both identification portions, the controller 400 may determine that the filter unit 50 is installed, and in response to one of the first sensor 410*a* and the second sensor 410*b* detecting a single identification portion, the controller 400 may determine that the dehumidification unit 100 is installed.

In addition, the first identification portion 54 and the second identification portion 120 may be provided at different positions from each other. For example, a position of the first identification portion 54, in a state in which the filter unit 50 is mounted on the dryer 1, may be different from a position of the second identification portion 124 in a state in which the dehumidification unit 100 and 200 is mounted on the dryer 1. For example, the first identification portion 54 may be provided on the upper right side of the front cover 52, and the second identification portion 124 may be provided on the upper left side of the front cover 120. In another example, the positions of the first identification portion 54 and the second identification portion 124 may be reversed. Accordingly, based on the detection position, the dryer 1 may easily determine whether the filter unit 50 is mounted and/or whether the dehumidification unit 100 is mounted.

In response to the first sensor 410*a* detecting the first identification portion 54, it may be recognized or determined (for example, by the controller 400) that the filter unit 50 is mounted on the dryer 1. In this case, the controller 400 may control the operation of the dryer 1 to perform the drying operation (drying mode). In other words, the controller 400 may determine whether to perform the drying mode based on information (e.g., a signal) received from the first sensor 410*a*. In response to the second sensor 410*b* detecting the second identification portion 124, it may be recognized or determined (for example, by the controller 400) that the dehumidification unit 100 is mounted on the dryer 1. In this case, the controller 400 may control the operation of the dryer 1 to perform the dehumidifying operation (dehumidifying mode). In other words, the controller 400 may determine whether to perform the dehumidifying mode based on information (e.g., a signal) received from the second sensor 410*b*.

In some circumstances, a user may operate the dryer 1 in the dehumidifying mode in the state in which the filter unit 50 is mounted, or a user may operate the dryer 1 in the drying mode in the state in which the dehumidification unit 100 is mounted. In this case, the dryer 1 may not appropriately perform the dehumidification function or the drying function. Accordingly, the dryer 1 according to the disclosure may be programmed in such a way that, by the controller 400, the dryer 1 is not operated in the dehumidifying mode in response to detecting that the filter unit 50 is mounted, and the dryer 1 is not operated in the drying mode in response to detecting that the dehumidification unit 100 is mounted.

For example, in response to the first sensor 410*a* detecting the first identification portion 54, the controller 400 may recognize or determine that the filter unit 50 is mounted on the dryer 1 based on information (e.g., a signal) received from the first sensor 410*a*. In this case, in response to a user providing an input, for example, via the manipulator 17, to perform a dehumidifying operation, the controller 400 may prevent the dehumidifying operation from being performed, and may control the manipulator 17 to output a message or sound indicating that the dryer is unable to perform the dehumidifying operation and/or informing the user that the filter unit 50 is mounted on the dryer 1 and should be replaced by the dehumidification unit 100 in order to perform the dehumidifying operation.

For example, in response to the second sensor 410*b* detecting the second identification portion 124, the controller 400 may recognize or determine that the dehumidification unit 100 is mounted on the dryer 1 based on information (e.g., a signal) received from the second sensor 410*b*. In this case, in response to a user providing an input, for example, via the manipulator 17, to perform a drying operation, the controller 400 may prevent the drying operation from being performed, and may control the manipulator 17 to output a message or sound indicating that the dryer is unable to perform the drying operation and/or informing the user that the dehumidification unit 100 is mounted on the dryer 1 and should be replaced by the filter unit 50 in order to perform the drying operation.

Further, the dryer 1 may include a detection sensor 420 (refer to FIG. 19) configured to detect an object, which is to be dried, accommodated in the drum 20. In a state in which the object to be dried remains inside the drum 20, the object to be dried may act as an obstacle on the open flow path, so the dehumidification efficiency may be greatly reduced and power may be consumed greatly during the dehumidifying operation. Accordingly, in response to the detection sensor 420 detecting the object to be dried, the controller 400 may prevent the dehumidifying mode from being performed. In addition, in response to the detection sensor 420 detecting the object to be dried, the detection may be displayed on the display 17*b* to notify a user. Accordingly, the user can intuitively identify the presence of the object to be dried. For example, in response to the detection sensor 420 detecting the object accommodated in the drum 20, the controller 400 may recognize or determine that the drum 20 is not empty based on information (e.g., a signal) received from the detection sensor 420. In this case, in response to a user providing an input, for example, via the manipulator 17, to perform a dehumidifying operation, the controller 400 may prevent the dehumidifying operation from being performed based on the controller 400 determining that the drum 20 is not empty, and the controller may control the manipulator 17 to output a message or sound indicating that the dryer is unable to perform the dehumidifying operation and/or informing the user that the drum 20 is not empty and that the object should be removed from the dryer 1 in order to perform the dehumidifying operation.

For example, the detection sensor 420 may include at least one of a weight detection sensor 420*a* and a moisture detection sensor 420*b*. That is, the detection sensor 420 may include (1) at least one weight detection sensor 420*a*, (2) at least one moisture detection sensor 420*b*, or (3) at least one weight detection sensor 420*a* and at least one moisture detection sensor 420*b*. For example, in response to the weight detection sensor 420*a* detecting a weight exceeding a weight of the empty drum 20 or a predetermined reference value, it may be recognized or determined (e.g., by controller 400) that there is an object to be dried inside the drum 20. In response to the moisture detection sensor 420*b* detecting moisture greater than or equal to a predetermined reference value in the drum 20, it may be recognized or determined (e.g., by controller 400) that there is an undried object, which is to be dried, inside the drum 20. That is, in response to the weight detection sensor 420*a* and/or the moisture detection sensor 420*b* detecting the object present in the drum, the controller 400 may control the operation of the dryer to prevent the dehumidifying operation (dehumidifying mode) from being performed. For example, in response to the weight detection sensor 420*a* and/or the moisture detection sensor 420*b* detecting the object accommodated in the drum 20, the controller 400 may recognize or determine that the drum 20 is not empty based on information (e.g., a signal) received from the weight detection sensor 420*a* and/or the moisture detection sensor 420*b*. In this case, in response to a user providing an input, for example, via the manipulator 17, to perform a dehumidifying operation, the controller 400 may prevent the dehumidifying operation from being performed based on the controller 400 determining that the drum 20 is not empty, and the controller may control the manipulator 17 to output a message or sound (e.g., an alarm) indicating that the dryer is unable to perform the dehumidifying operation and/or informing the user that the drum 20 is not empty and that the object should be removed from the dryer 1 in order to perform the dehumidifying operation.

The dehumidification unit 200 according to an example embodiment of the disclosure will be described. The same reference numbers or symbols refer to parts or components that perform substantially the same functions, and a detailed description thereof will be omitted.

Figure 15:
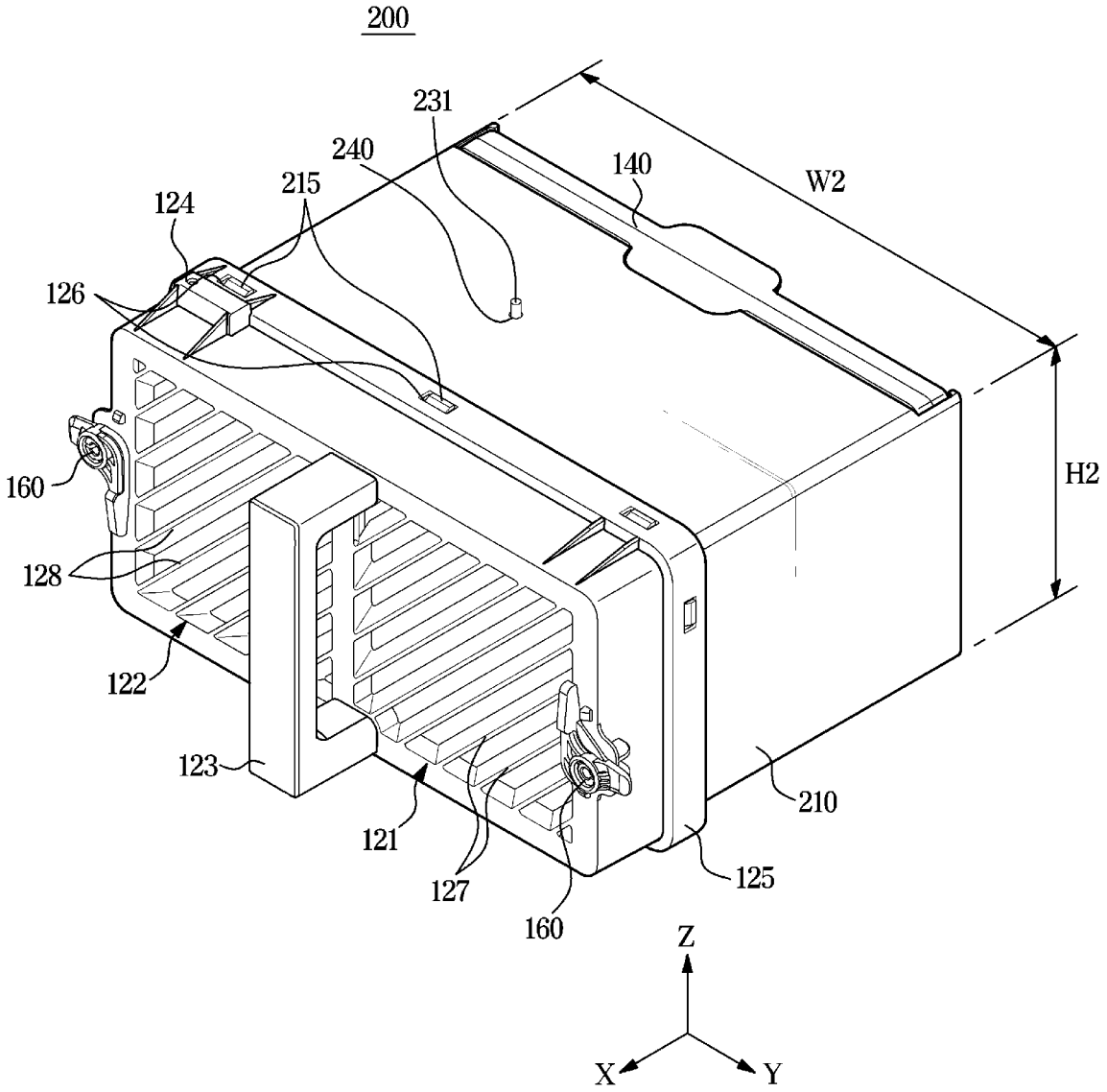
FIG. 15 is a view of a dehumidification unit according to an embodiment of the disclosure.
Figure 16:
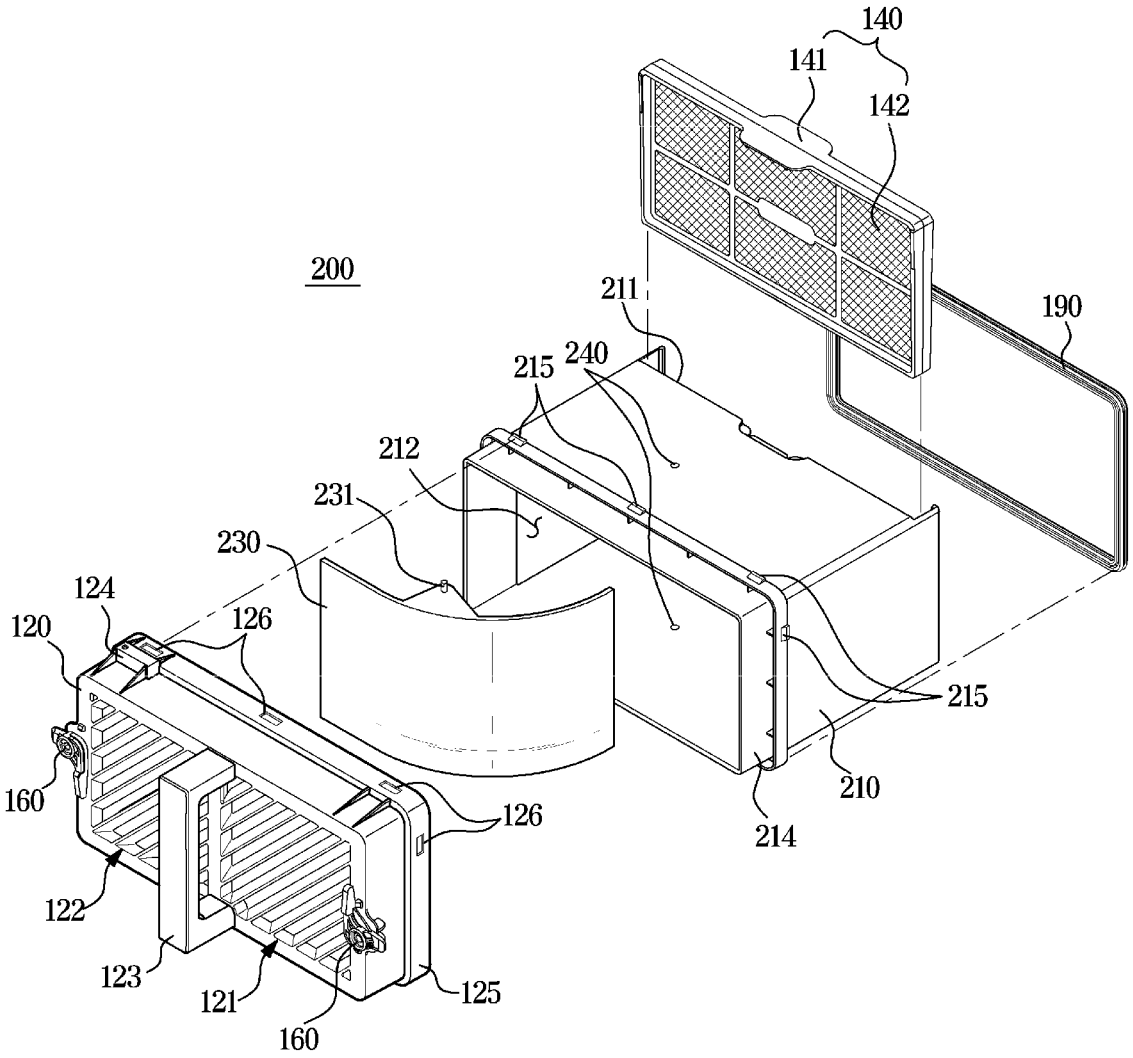
FIG. 16 is an exploded view of the dehumidification unit illustrated in FIG. 15.
Figure 17:
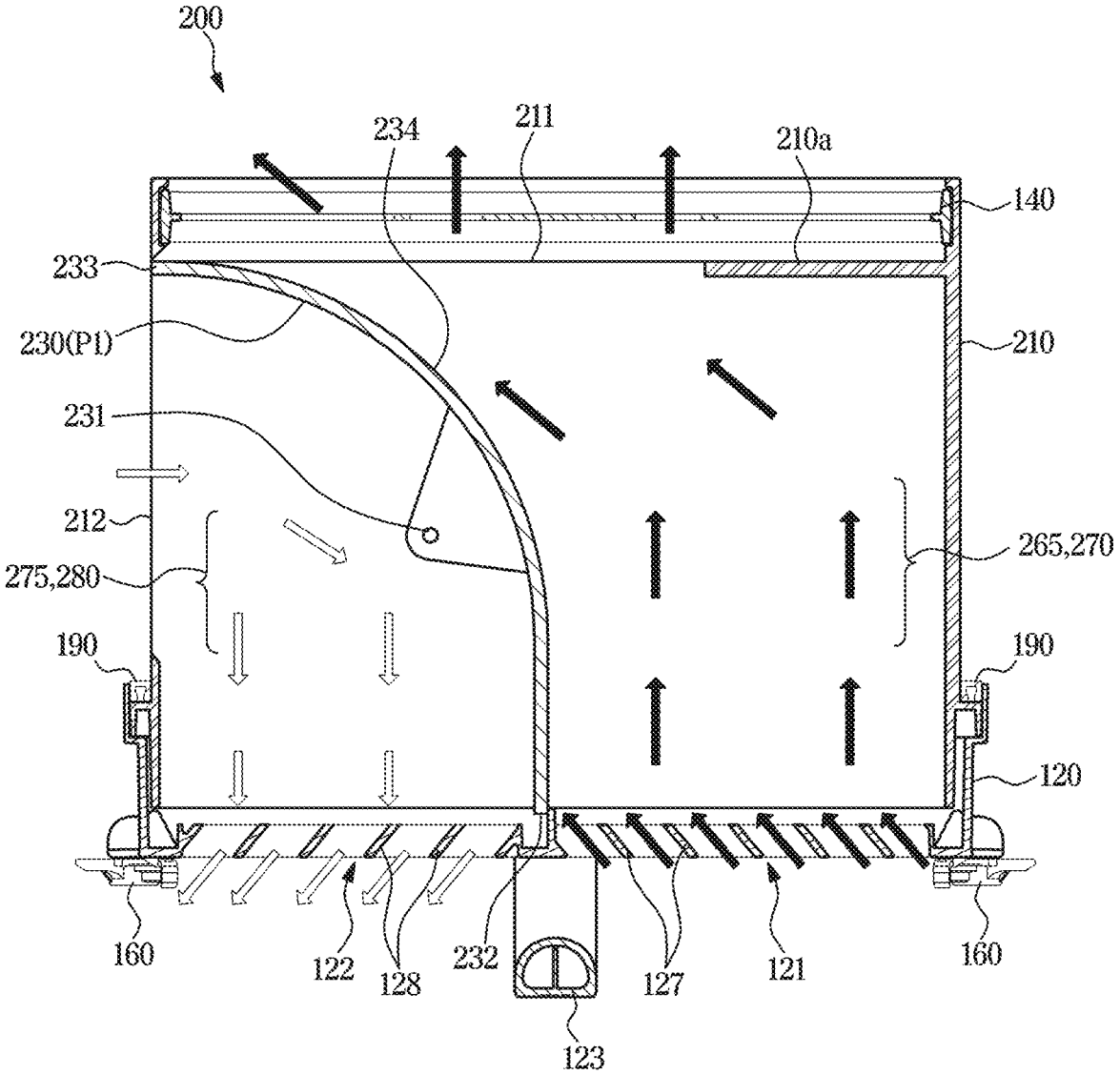
FIG. 17 is a sectional view illustrating a state in which a guide of the dehumidification unit illustrated in FIG. 15 is located at a first position.
Figure 18:
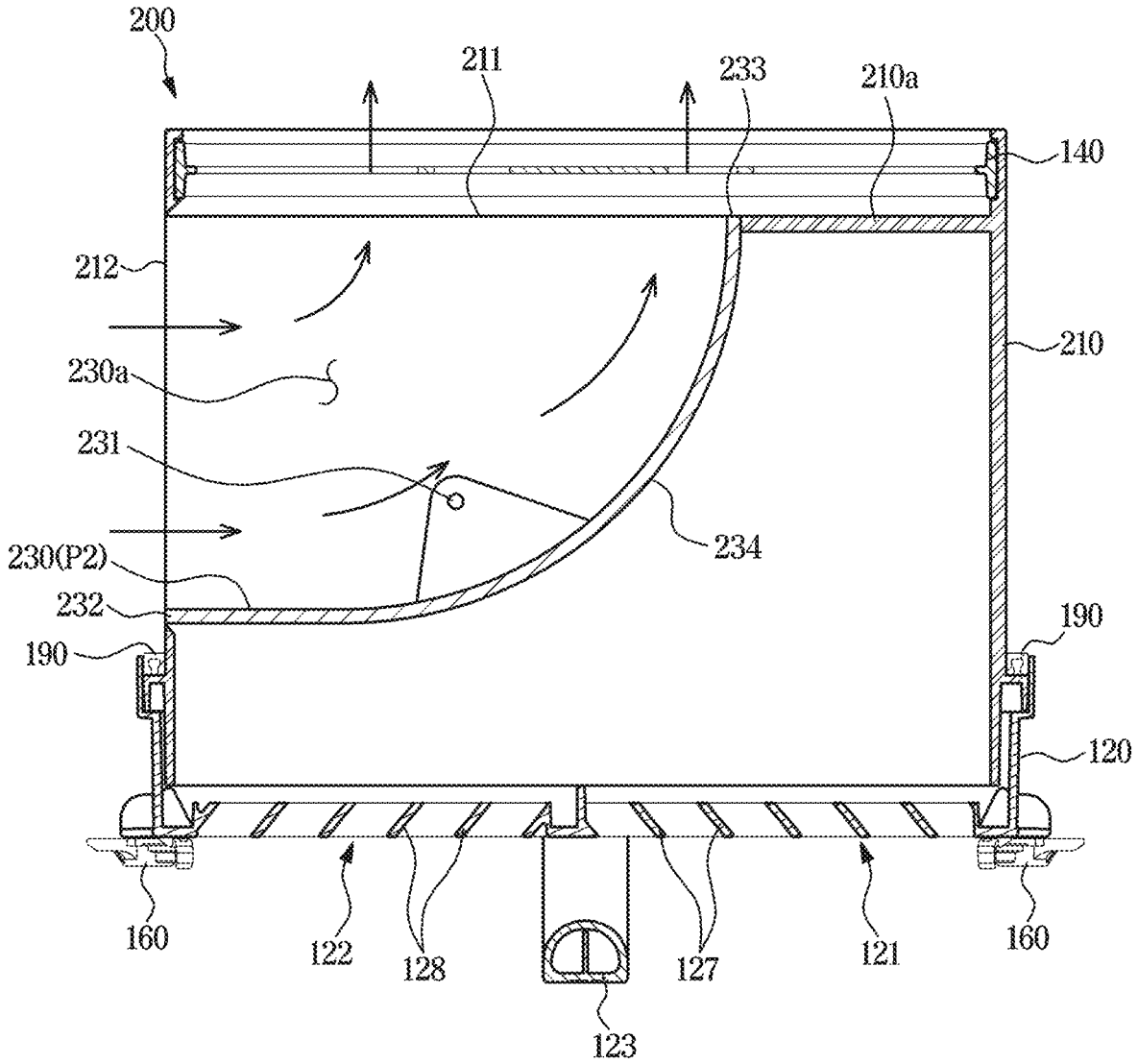
FIG. 18 is a sectional view illustrating a state in which the guide of the dehumidification unit illustrated in FIG. 15 is located at a second position.

FIG. 15 is a view of a dehumidification unit according to an example embodiment of the disclosure. FIG. 16 is an exploded view of the dehumidification unit illustrated in FIG. 15. FIG. 17 is a sectional view illustrating a state in which a guide of the dehumidification unit illustrated in FIG. 15 is located at a first position. FIG. 18 is a sectional view illustrating a state in which the guide of the dehumidification unit illustrated in FIG. 15 is located at a second position.

As illustrated in FIGS. 15 and 16, the dehumidification unit 200 may include a body 210. The body 210 may include a body mounting portion 214 and a mounting protrusion 215 for coupling with the front cover 120. The body mounting portion 214 performs the same function as the above-described body mounting portion 114, and the mounting protrusion 215 performs the same function as the mounting protrusion 115, and thus a detailed description thereof will be omitted.

A front cover 120 may be coupled to the front side of the body 210. A suction filter 140 may be provided at the rear side of the body 210. A sealing member 190 may be provided between the body 210 and the front cover 120.

The dehumidification unit 200 may be formed in a cuboid shape with a wide width W2 and a low height H2. That is, the width W2 may be greater than the height H2, and thus it is efficient to divide the width W2 into halves and form an inlet port 121 and an outlet port 122, respectively. That is, an area occupied by the inlet port 121 and an area occupied by the outlet port 122 on the front surface of the dehumidification unit 100 may be approximately the same and thus a flow rate of the inflow air and a flow rate of the exhaust air may be equal.

A discharge port 211 may be provided at a first side of the body 210 of the dehumidification unit 200. For example, the discharge port 211 may be formed on a rear side of the body 210 which faces in a direction toward the heat exchanger 70. The discharge port 211 may guide the outside air, which is introduced through the inlet port 121, to the heat exchanger 70. That is, the discharge port 211 may communicate with the inlet port 121. The heat exchanger 70 may be disposed at the rear side of the discharge port 211, and the discharge port 211 may be disposed to face the heat exchanger 70. The introduced outside air may be air in a state before dehumidification, and the air may be high-humid air (i.e., air having a high humidity).

An intake port 212 may be provided at a second side of the body 210 of the dehumidification unit 200. For example, the intake port 212 may be formed on the lateral side of the body 210. FIGS. 16 to 18 illustrate that the intake port 212 is formed on the left side of the body 210, but the disclosure is not limited thereto. For example, the intake port 212 may be formed on the right side of the body 210. The intake port 212 may accommodate air that has passed through the heat exchanger 70. The intake port 212 may communicate with the outlet port 122 to allow air, which has passed through the heat exchanger 70, to be discharged to the outside through the outlet port 122. The air which has passed through the heat exchanger 70 may be air that is dehumidified by exchanging heat with the heat exchanger 70, and thus the air may be high-temperature and dry air. In other words, the air which has passed through the heat exchanger 70 may have a higher temperature than the air which is discharged from the discharge port 211 before passing through the heat exchanger 70. Likewise, the air which has passed through the heat exchanger 70 may have a lower humidity than the air which is discharged from the discharge port 211 before passing through the heat exchanger 70.

Unlike the above-described dehumidification unit 100, the dehumidification unit 200 may include a guide 230. The guide 230 may divide the inner space of the dehumidification unit 200 in different ways in different positions of the guide. For example, the guide 230 may be rotatably provided inside the body 210. The guide 230 may also be referred as a wall portion, partition or movable partition.

The guide 230 may include a rotating shaft 231 rotatably coupled to the body 210, and the body 210 may include a coupling hole 240 corresponding to the rotating shaft 231. The guide 230 may be rotated within a predetermined range while the rotating shaft 231 is inserted into the coupling hole 240. However, the disclosure is not limited thereto. For example, in an opposite configuration, the body 210 may include a rotating shaft, and the guide 230 may include a coupling hole. As illustrated in FIG. 15, the rotating shaft 231 may be protrude out of an upper surface of the body 210.

As illustrated in FIG. 17, the guide 230 may be located at a first position P1 to divide the inner space of the dehumidification unit 200 into first and second chambers 265, 275. The first chamber 265 provides an inlet flow path 270 for air from outside the cabinet to be supplied to the heat exchanger 70 through the second opening 65. The second chamber 275 provides an outlet flow path 280 for air discharged from the heat exchanger 70 to be discharged through the second opening 65. The guide 230 may form the inlet flow path 270 by allowing the discharge port 211 to communicate with the inlet port 121. The guide 230 may form the outlet flow path 280 partitioned from the inlet flow path 270 by allowing the intake port 212 to communicate with the outlet port 122. The inlet flow path 270 performs the same function as the above-described inlet flow path 170, and the outlet flow path 280 performs the same function as the above-described outlet flow path 180, and a detailed description thereof will be omitted.

Further, as illustrated in FIG. 18, the guide 230 may be located at a second position P2 provided to form a flow path 230*a* by allowing the discharge port 211 to communicate with the intake port 212. In addition, when the guide 230 is located at the second position P2, the guide 230 may block communication between the discharge port 211 and the inlet port 121 and block the communication between the intake port 212 and the outlet port 122. The flow path 230*a* may be a partial region of the closed flow path, and may perform the same function as the flow path 50*a* formed inside the filter unit 50.

The guide 230 may be configured to be movable between the first position P1 and the second position P2. Further, the guide 230 may be rotatably disposed. That is, the guide 230 may be rotated from the first position P1 and switched to the second position P2. In addition, the guide 230 may be rotated from the second position P2 and switched to the first position P1. For example, a user may manually rotate the guide 230 (e.g., by rotating the rotating shaft 231) from the first position P1 to the second position P2 to perform a drying operation in the drying mode before installing the dehumidification unit 200 in the dryer 1. For example, a user may manually rotate the guide 230 (e.g., by rotating the rotating shaft 231) from the second position P2 to the first position P1 to perform a dehumidification operation in the dehumidifying mode before installing the dehumidification unit 200 in the dryer 1. In an example, the dehumidification unit 200 may be fixedly or permanently installed in the dryer 1. In another example, the dehumidification unit 200 may be insertable, installable, attachable, or mountable to the dryer 1, and removable or detachable from the dryer 1.

For example, when the guide 230 is located at the first position P1, the open flow path may be formed inside the dryer 1. In this case, both ends (that is, the inlet port 121 and the outlet port 122) of the open flow path may communicate with the outside, respectively. That is, when the guide 230 is located at the first position P1, the dryer 1 may perform the dehumidifying operation (operate in the dehumidifying mode). When the guide 230 is located at the second position P2, the closed flow path may be formed inside the dryer 1. That is, when the guide 230 is located at the second position P2, the dryer 1 may perform the drying operation (operate in the drying mode). As illustrated in FIGS. 17 and 18, a protruding portion 210*a* of the body 210 may be located at a rear of the body 210 and extend from an inner side surface of the body 210 in a direction toward a side of the body 210 at which the intake port 212 is located. A length of the protruding portion 210*a* is such that when the guide 230 is located at the second position P2 the end 233 of the guide 230 abuts the protruding portion 210 so as to close off the inlet flow path 270 between the inlet 121 and the discharge port 211, and form the closed flow path. In summary, a driving mode of the dehumidification unit 200 may be changed or switched (e.g., between the drying mode or dehumidifying mode) according to the rotation of the guide 230. Accordingly, the dryer 1 may easily switch between the drying mode for drying an object to be dried and the dehumidifying mode for indoor dehumidification.

Further, the guide 230 may include a curved portion 234. The guide 230 may be partially curved to allow the inlet flow path 270 and the outlet flow path 280 to be smooth. For example, as illustrated in FIG. 17, when the guide 230 is located at the first position P1, the guide 230 may form a curved section on the outlet flow path 280. In addition, the guide 230 may be curved such that the inlet flow path 270 extends toward the rear side of the body 210. That is, a width of the inlet flow path 270 may increase in a front to rear direction of the body 210. For example, the width of the inlet flow path 270 may be equal to or correspond to a width of the body 210 at a rear side of the body 210, as the curved portion 234 curves away in a direction toward the intake port 212. However, the disclosure is not limited thereto, and the curved portion 234 may be curved more sharply or less sharply, for example. Because the guide 230 includes the curved portion 234, air may be smoothly introduced or discharged.

Alternatively, the guide 230 may be configured to be automatically rotatable. For example, the guide 230 may receive a rotational force by being connected to a rotation motor (not shown).

For example, the guide 230 may automatically switch the flow path formed inside the dryer 1 from the closed flow path to the open flow path. That is, as the guide 230 moves from the second position P2 to the first position P1, the dryer 1 may be switched from the drying mode to the dehumidifying mode. For example, in response to the manipulator 17 receiving an input (e.g., from a user) for the dryer to perform a dehumidifying operation, the controller 400 may be configured to control the rotation motor to rotate the guide 230 from the second position P2 to the first position P1. As mentioned in previous examples, the controller 400 may be configured to prevent the dehumidifying operation from being performed if an object remains in the drum 20. As another example, in response to detecting that a drying operation has completed (e.g., within a predetermined amount of time), and the drum 20 is empty (e.g., no objects are present within the drum 20), the controller 400 may be configured to automatically control the rotation motor to rotate the guide 230 from the second position P2 to the first position P1 and may control the dryer 1 to perform a dehumidifying operation, i.e., without receiving an input from a user via the manipulator 17 to perform the dehumidifying operation. In addition, the guide 230 may switch the flow path formed inside the dryer 1 from the open flow path to the closed flow path. That is, as the guide 230 moves from the first position P1 to the second position P2, the dryer 1 may be switched from the dehumidifying mode to the drying mode. In other words, because the guide 230 is automatically rotatable, a user can easily select the drying mode or the dehumidifying mode. For example, in response to the manipulator 17 receiving an input (e.g., from a user) for the dryer to perform a drying operation, the controller 400 may be configured to control the rotation motor to rotate the guide 230 from the first position P1 to the second position P2. As another example, the controller 400 may be configured to automatically control the rotation motor to rotate the guide 230 from the first position P1 to the second position P2 in response to a dehumidifying operation being completed.

Accordingly, even when the dehumidification unit 200 is mounted on the dryer 1, the drying mode may be performed when the guide 230 is located at the second position P2. In other words, in order to perform the drying mode, there is no need to mount the filter unit 50 to the dryer 1 again after the dehumidification unit 200 is removed from the dryer 1. That is, the inconvenience of mounting and/or attaching a separate component (e.g., the filter unit 50) is eliminated. As a result, according to the disclosure, the dryer 1 may automatically change the flow path, and thus a user can freely select the drying mode or the dehumidifying mode.

Further, a guide sensor 430 (also referred to as a partition sensor) (refer to FIG. 19) of the dryer 1 may detect a position of the guide 230. For example, the guide sensor 430 may distinguish between a case in which the guide 230 is at the first position P1 and a case in which the guide 230 is at the second position P2. For example, by detecting the positions of both ends 232 and 233 of the guide 230, the guide sensor 430 may distinguish between the case, in which the guide 230 is at the first position P1, and the case, in which the guide 230 is at the second position P2. Accordingly, the controller 400 may quickly recognize or determine whether the drying mode or the dehumidifying mode may be performed, and it is possible to prevent a delay due to the switching of the driving mode of the dryer 1. As a result, power consumption may be minimized.

A dehumidification unit 300 according to an example embodiment of the disclosure will be described. The same reference numbers or symbols refer to parts or components that perform substantially the same function, and a detailed description thereof will be omitted.

Figure 20:
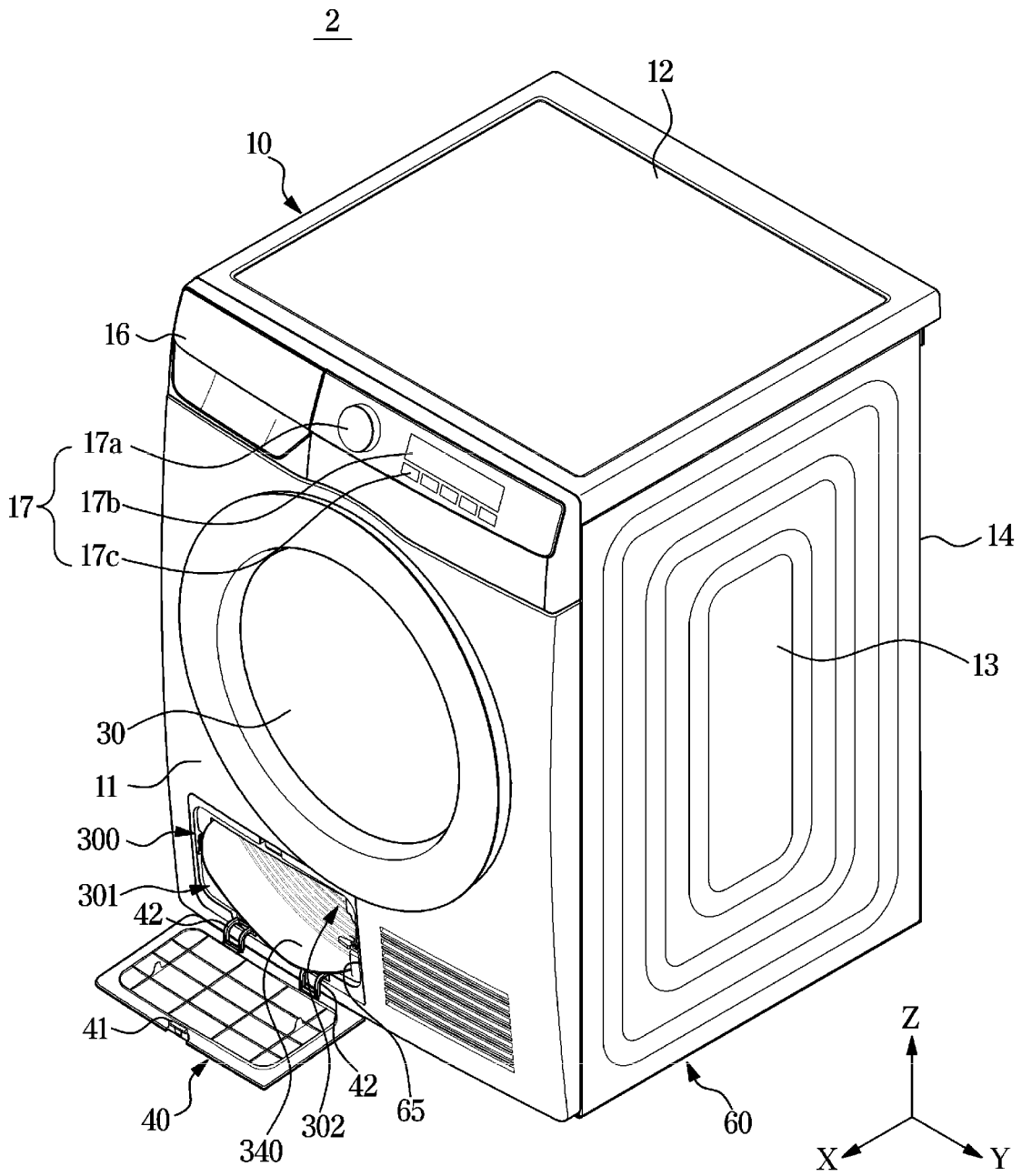
FIG. 20 is a view of a dryer to which a dehumidification unit according to an embodiment of the disclosure is mounted.
Figure 22:
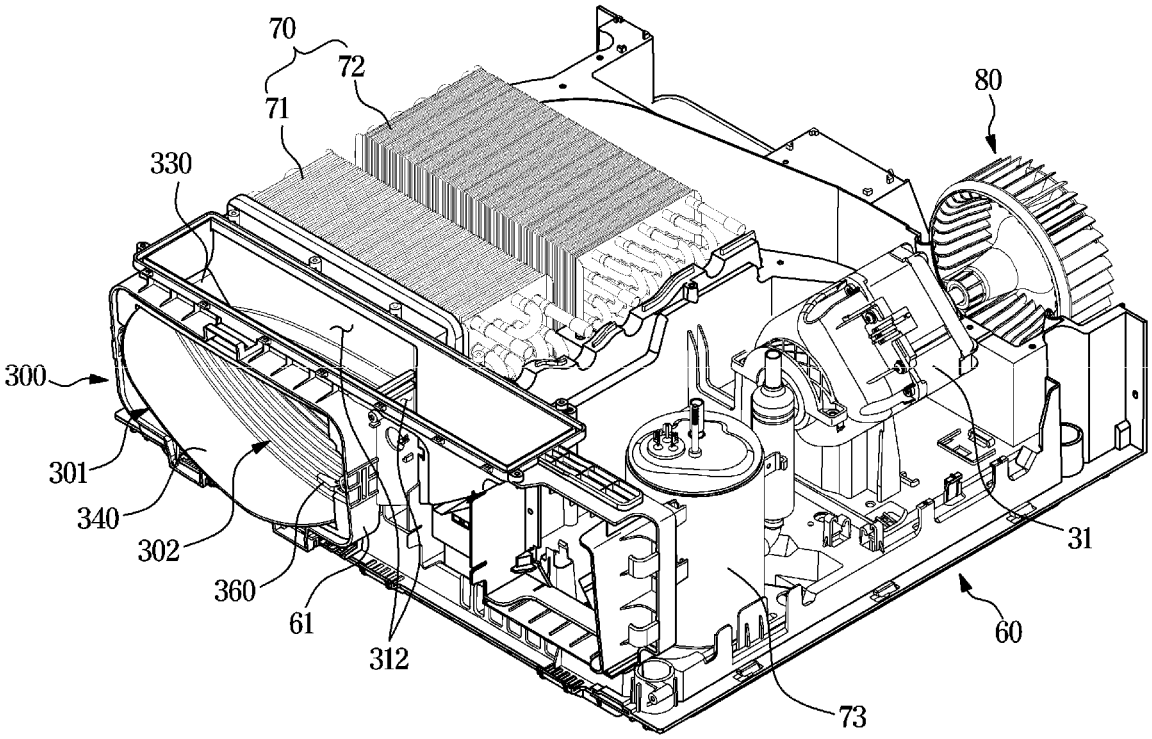
FIG. 22 is a view of a base of the dryer illustrated in FIG. 20.
Figure 23:
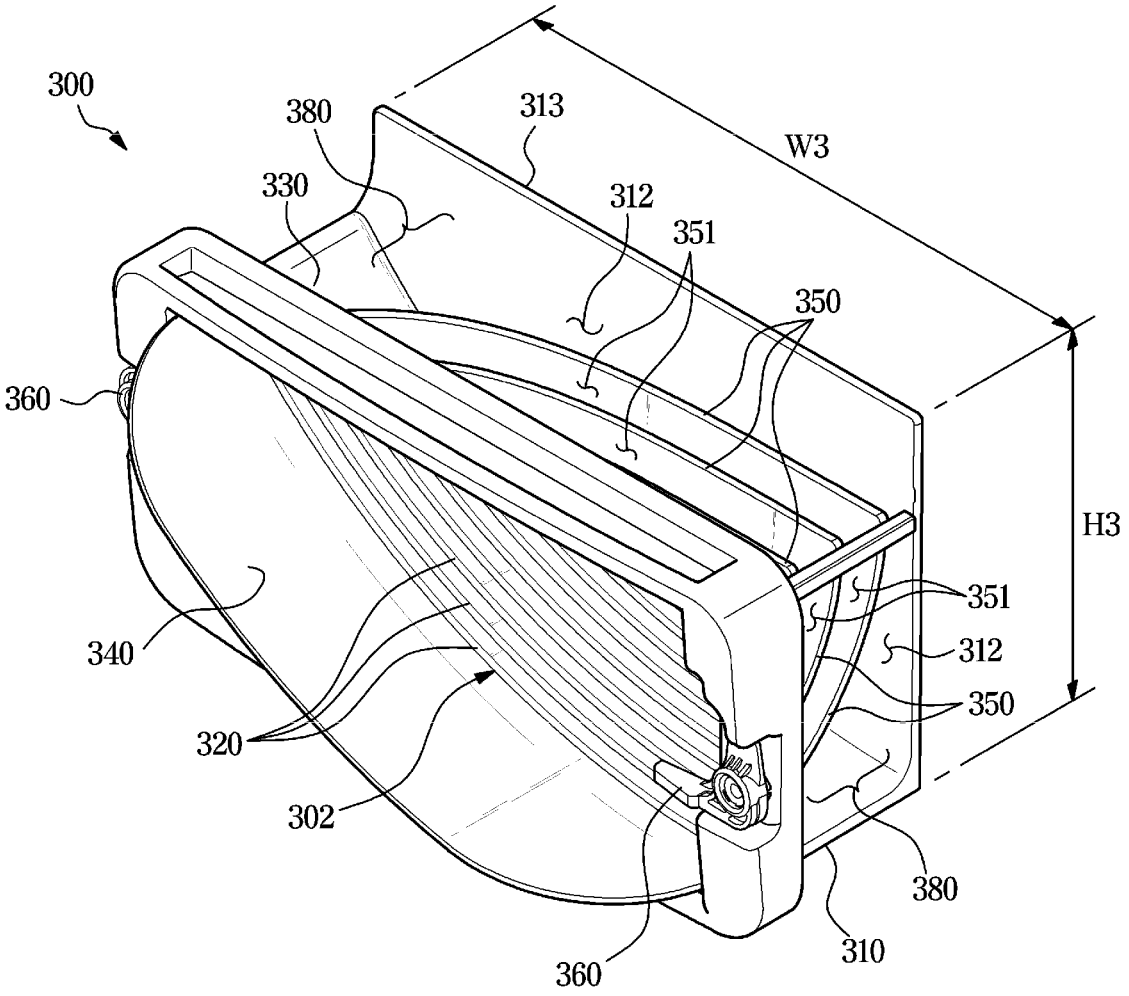
FIG. 23 is a view of the dehumidification unit illustrated in FIG. 20.
Figure 24:
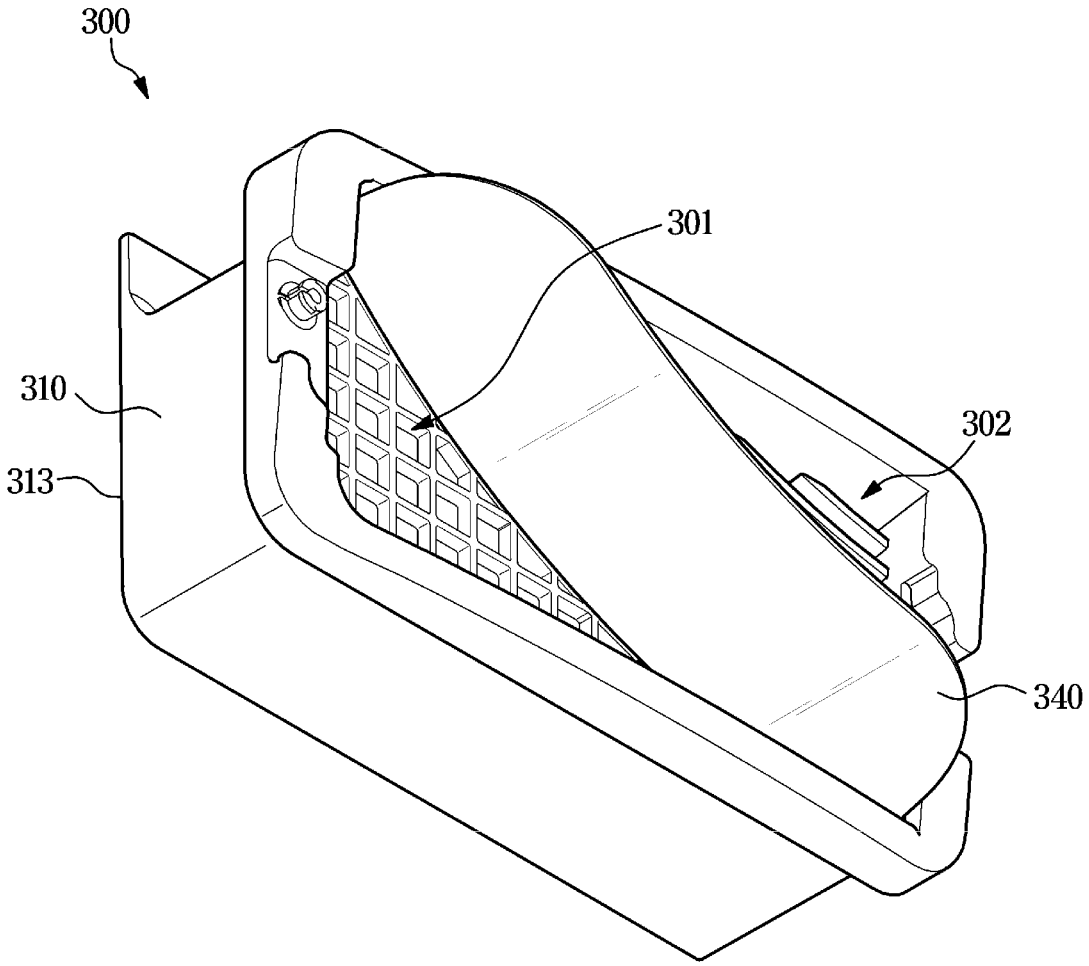
FIG. 24 is a view of the dehumidification unit illustrated in FIG. 23 when viewed from a different direction.
Figure 25:
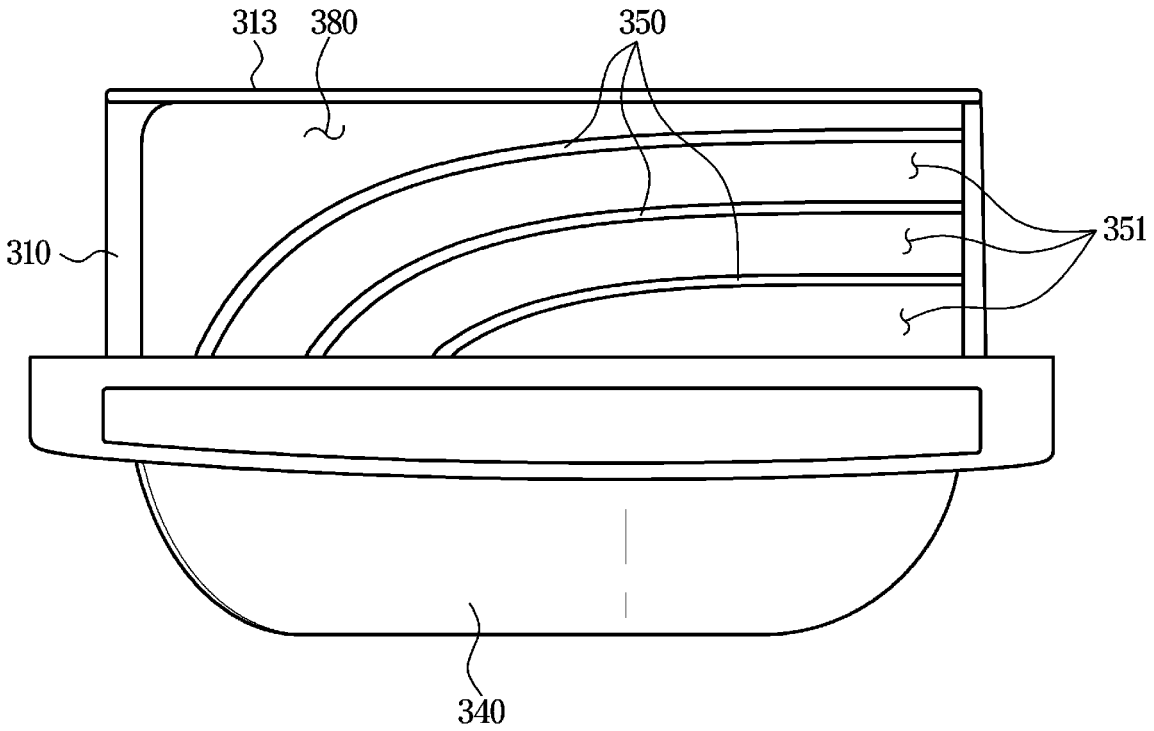
FIG. 25 is a top plan view of the dehumidification unit illustrated in FIG. 23.

FIG. 20 is a view of a dryer to which a dehumidification unit according to an example embodiment of the disclosure is mounted. FIG. 21 is a vertical cross-sectional view of the dryer illustrated in FIG. 20. FIG. 22 is a view of a base of the dryer illustrated in FIG. 20. FIG. 23 is a view of the dehumidification unit illustrated in FIG. 20. FIG. 24 is a view of the dehumidification unit illustrated in FIG. 23 when viewed from different directions.

Referring to FIG. 20, the dehumidification unit 300 may be detachably mounted to a dryer 2. The dehumidification unit 300 may be mounted to the dryer 2 instead of the filter unit 50. The dehumidification unit 300 may be mounted to the inside of the cabinet 10 through the second opening 65 provided on the front surface 11 of the cabinet 10. For example, the dehumidification unit 300 may be mounted on the unit accommodating portion 61.

As illustrated in FIG. 22, the dehumidification unit 300 may be provided on the base 60. For example, the dehumidification unit 300 may be detachably mounted to the base 60.

For example, when the dehumidification unit 300 is mounted on the dryer 2, an open flow path may be formed inside the cabinet 10 of the dryer 2. The open flow path may be an air movement path (refer to arrows in FIG. 20) in which outside air is sucked into the dryer 2, is passed through the heat exchanger 70 and the drum 20, and is then discharged to the outside of the dryer 2. Alternatively, the open flow path may be an air movement path in which outside air is sucked into the dryer 2, is passed through the heat exchanger 70, and is then discharged to the outside of the dryer 2. Both ends of the open flow path (inlet port 301 and outlet port 302 to be described later) may communicate with the outside of the cabinet 10, respectively, and a flow of air may form an open loop.

As illustrated in FIG. 21, when the dehumidification unit 300 is mounted on the dryer 2, the open flow path may be formed inside the cabinet 10. Accordingly, the dryer 2 may perform the dehumidifying operation (operate in a dehumidifying mode). That is, the drying function and the dehumidification function may be implemented with one dryer 2. In addition, a user does not need to purchase a separate dryer and dehumidifier. As a result, the dryer 2 according to the embodiment of the disclosure has excellent effects in terms of securing space and reducing costs.

Figure 26:
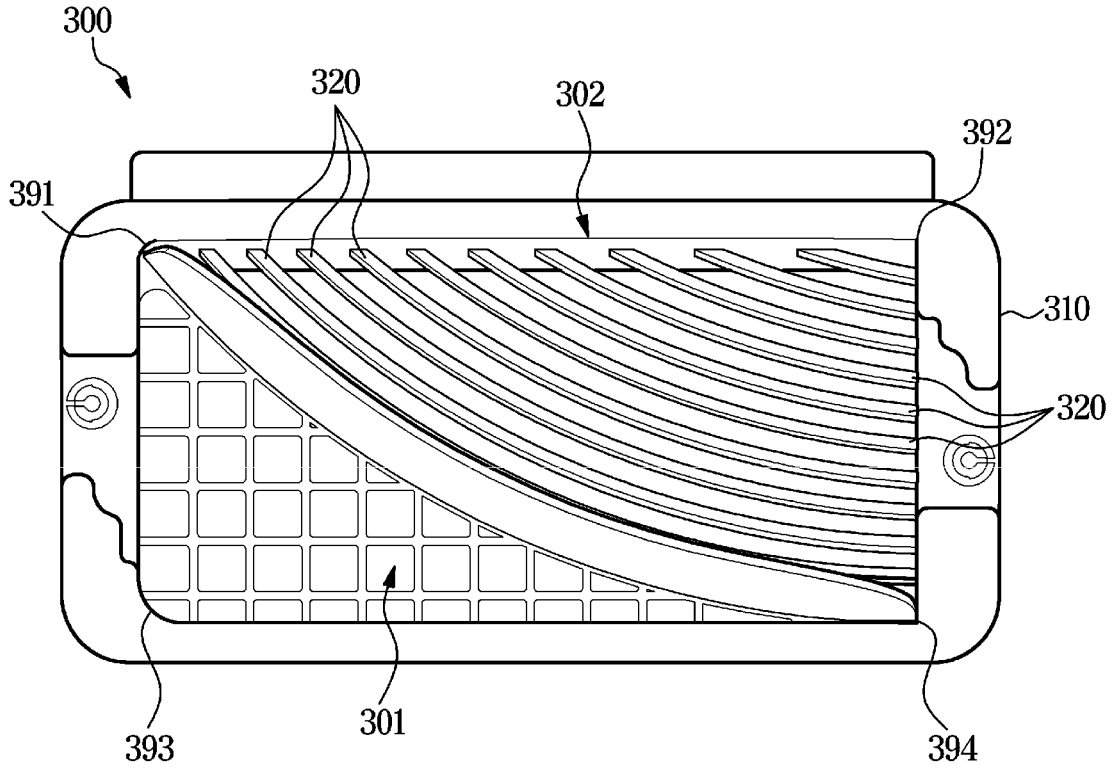
FIG. 26 is a front view of the dehumidification unit illustrated in FIG. 23.
Figure 27:
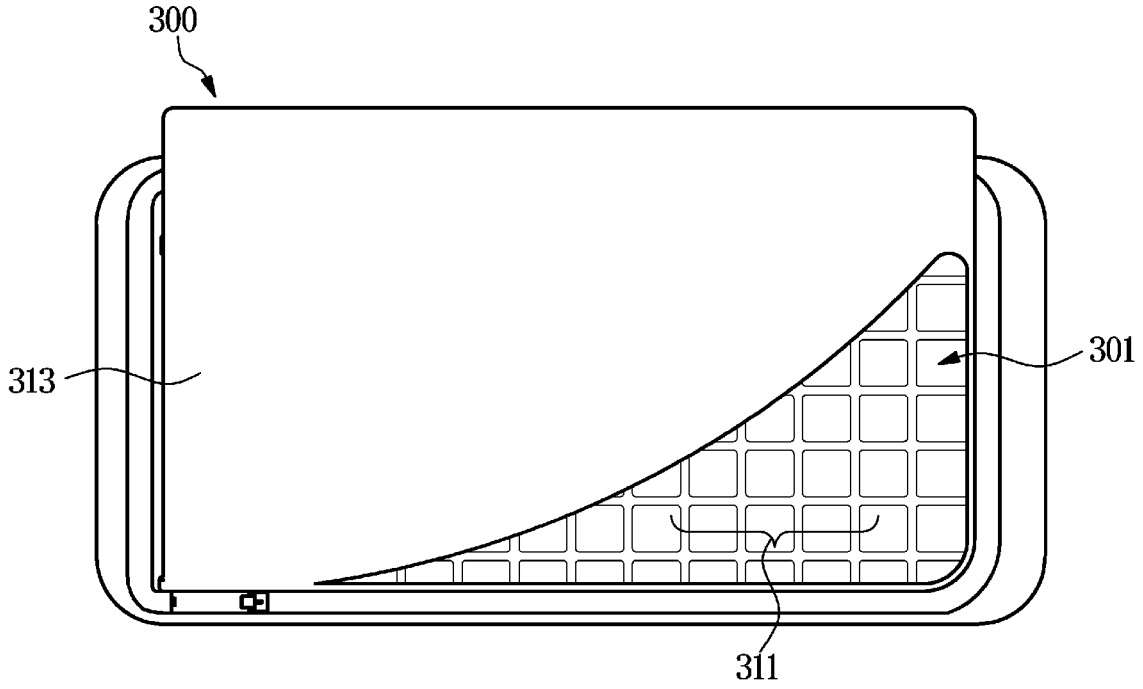
FIG. 27 is a rear view of the dehumidification unit illustrated in FIG. 23.
Figure 28:
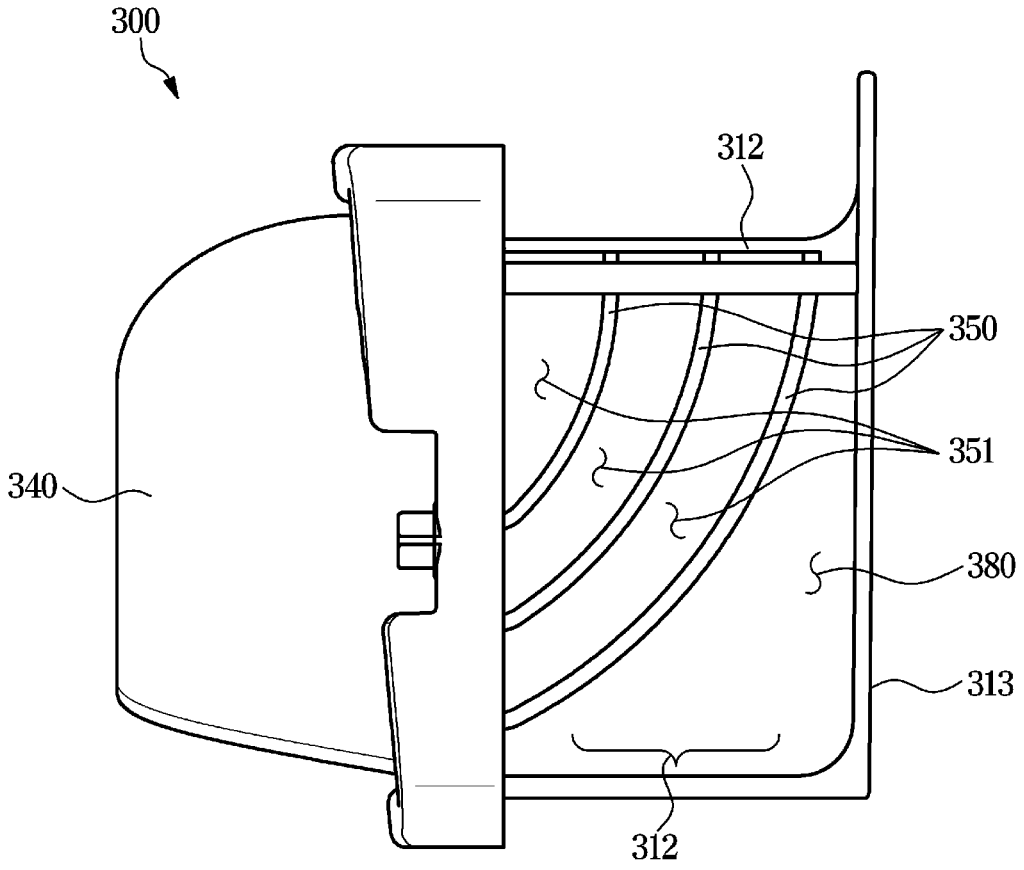
FIG. 28 is a left-side view of the dehumidification unit illustrated in FIG. 23.
Figure 29:
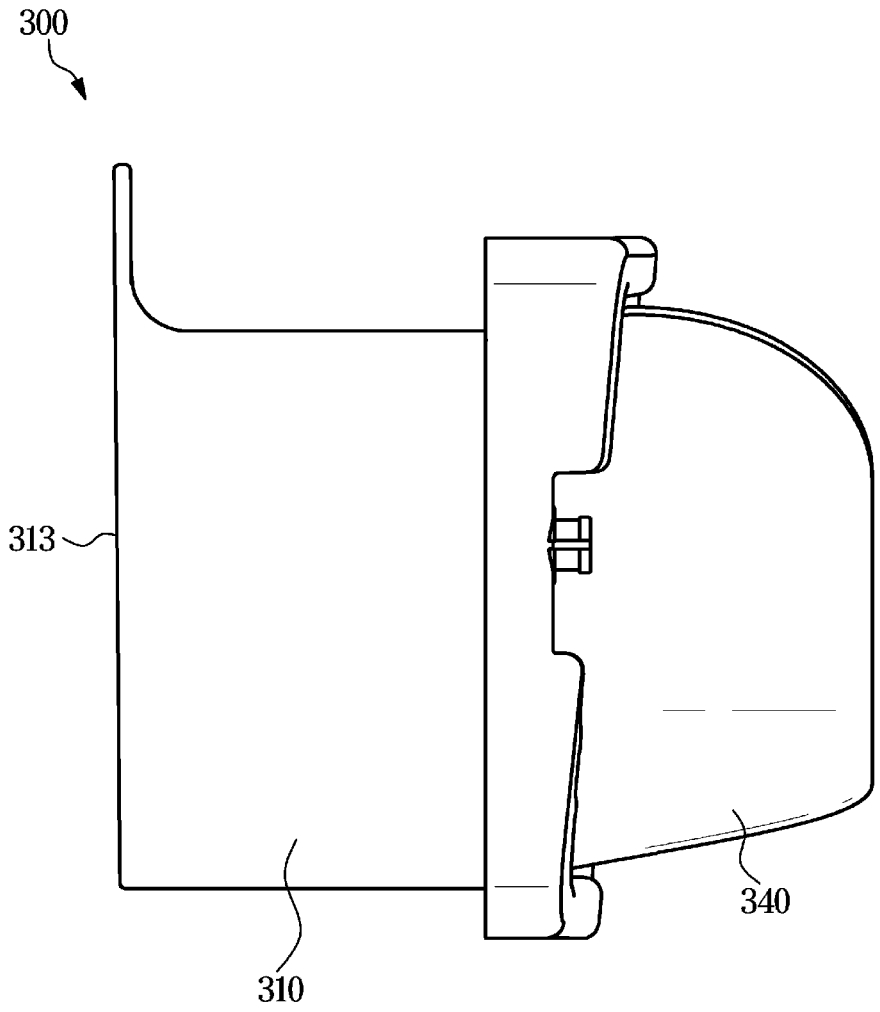
FIG. 29 is a right-side view of the dehumidification unit illustrated in FIG. 23.

Referring to FIGS. 23 and 24, the dehumidification unit 300 may include a body 310. The inlet port 301 and the outlet port 302 may be provided on a front side of the body 310. The inlet port 301 may be provided to allow air to be introduced from the outside of the cabinet 10 through the second opening 65. The outlet port 302 may be provided to allow the air to be discharged to the outside of the cabinet 10 through the second opening 65. For example, the outside high-humid air may be sucked into the dryer 2 through the inlet port 301, and high-temperature and dry air may be discharged from the inside of the dryer 2 to the outside of the dryer 2 through the outlet port 302. As illustrated in FIGS. 21 and 26, at least a portion of the inlet port 301 may be provided below the outlet port 302. Additionally, the inlet port 301 may be provided below a protruding rib 340 to be described later.

A discharge port 311 may be formed in a portion of the body 310 of the dehumidification unit 300. For example, the discharge port 311 may be formed in at least a portion of a rear surface 313 of the body 110. However, the disclosure is not limited thereto, and the discharge port 311 may be formed at a position different from that shown in the drawings. The discharge port 311 may guide the outside air, which is introduced through the inlet port 301, to the heat exchanger 70. That is, the discharge port 311 may communicate with the inlet port 301, and may be disposed adjacent to the heat exchanger 70. The outside air introduced through the inlet port 301 may be air before dehumidification (air that has not been dehumidified by the heat exchanger 70), and thus the air may be high-humid air.

An intake port 312 may be formed in another portion of the body 310 of the dehumidification unit 300. For example, as illustrated in FIGS. 23, 28, 30, and 31, the intake port 312 may be formed in at least a portion of an upper surface and/or at least a portion of a side surface of the dehumidification unit 300. However, the disclosure is not limited thereto, and the intake port 312 may be formed at a position different from that shown in the drawings. The intake port 312 may receive air which has passed through the heat exchanger 70. For example, the intake port 312 may communicate with the outlet port 302 to allow air, which has passed through the heat exchanger 70, to be discharged to the outside through the outlet port 302. The air which has passed through the heat exchanger 70 may be air that is dehumidified by exchanging heat with the heat exchanger 70, and thus the air may be high-temperature and dry air. Alternatively, the air which has passed through the heat exchanger 70 may be air that exchanges heat with the heat exchanger 70 and flows out of the outlet 22 of the drum 20 by passing through the drum 20.

The dehumidification unit 300 may include a guide 330. The guide 330 may also be referred as a wall portion or partition. The guide 330 may be provided inside the body 310. The guide 330 may divide the inside of the body 310 into first and second chambers 365, 375. The first chamber 365 provides an inlet flow path 370 for air from outside the cabinet to be supplied to the heat exchanger 70 through the second opening 65. The second chamber 375 provides an outlet flow path 380 for air discharged from the heat exchanger to be discharged through the second opening 65. The guide 330 may include a curved portion. Accordingly, the inlet flow path 370 and the outlet flow path 380 may be formed to be smooth, and air may move smoothly. However, the guide 330 may also include a straight portion.

The inlet flow path 370 may be a passage through which the discharge port 311 and the inlet port 301 communicate with each other in the body 310. Air introduced into the body 310 through the inlet port 301 may be moved to the heat exchanger 70 through the discharge port 311 along the inlet flow path 370. That is, the air before dehumidification may be delivered to the heat exchanger 70 along the inlet flow path 370.

The outlet flow path 380 may be a passage through which the intake port 312 and the outlet port 302 communicate with each other in the body 310. Air introduced into the body 310 through the intake port 312 may be moved to the outside of the cabinet 10 through the outlet port 302 along the outlet flow path 380. That is, the dehumidified air, which is dried by passing through the heat exchanger 70, may be discharged to the outside of the cabinet 10 along the outlet flow path 380.

The guide 330 may extend in a diagonal direction inside the body 310. Referring to FIG. 26, when a region, in which the inlet port 301 and the outlet port 302 of the dehumidification unit 300 are provided, is viewed from the front, an upper left corner may be defined as a first corner 391, an upper right corner may be defined as a second corner 392, a lower left corner may be defined as a third corner 393, and a lower right corner may be defined as a fourth corner 394. In this case, the diagonal direction may be a direction connecting the first corner 391 to the fourth corner 394. However, the disclosure is not limited thereto, and the diagonal direction may be a direction connecting the second corner 392 to the third corner 393. Further, the diagonal direction may include a curved line or portion. That is, a certain portion of the guide 330 may be curved.

The inlet port 301 may be formed on one side of the guide 330 with respect to the diagonal direction. For example, the inlet port 301 may include a lattice-shaped frame.

The outlet port 302 may be formed on the other side with respect to the diagonal direction of the guide 330. For example, the outlet port 302 may include a plurality of outlet guide ribs 320. The plurality of outlet guide ribs 320 may serve to guide the dehumidified air to be smoothly discharged. Further, among the plurality of outlet guide ribs 320, outlet guide ribs adjacent to each other may be spaced apart from each other by a predetermined distance and arranged in parallel or in a concentric fashion.

As illustrated in FIG. 26, the inlet port 301 and outlet port 302 may be disposed on opposite sides with respect to the diagonal direction of the guide 330. The inlet port 301 and the outlet port 302 may be disposed on the same plane (e.g., Y-Z plane in FIG. 20). For example, according to the disclosure, the dehumidification unit 300 may be formed in a cuboid shape with a wide width W3 and a low height H3. For example, the width W3 may be greater than the height H3. Further, an area occupied by the inlet port 301 and an area occupied by the outlet port 302 on the front surface of the dehumidification unit 300 may be approximately the same and thus a flow rate of the inflow air and a flow rate of the exhaust air may be equal.

Figure 31:
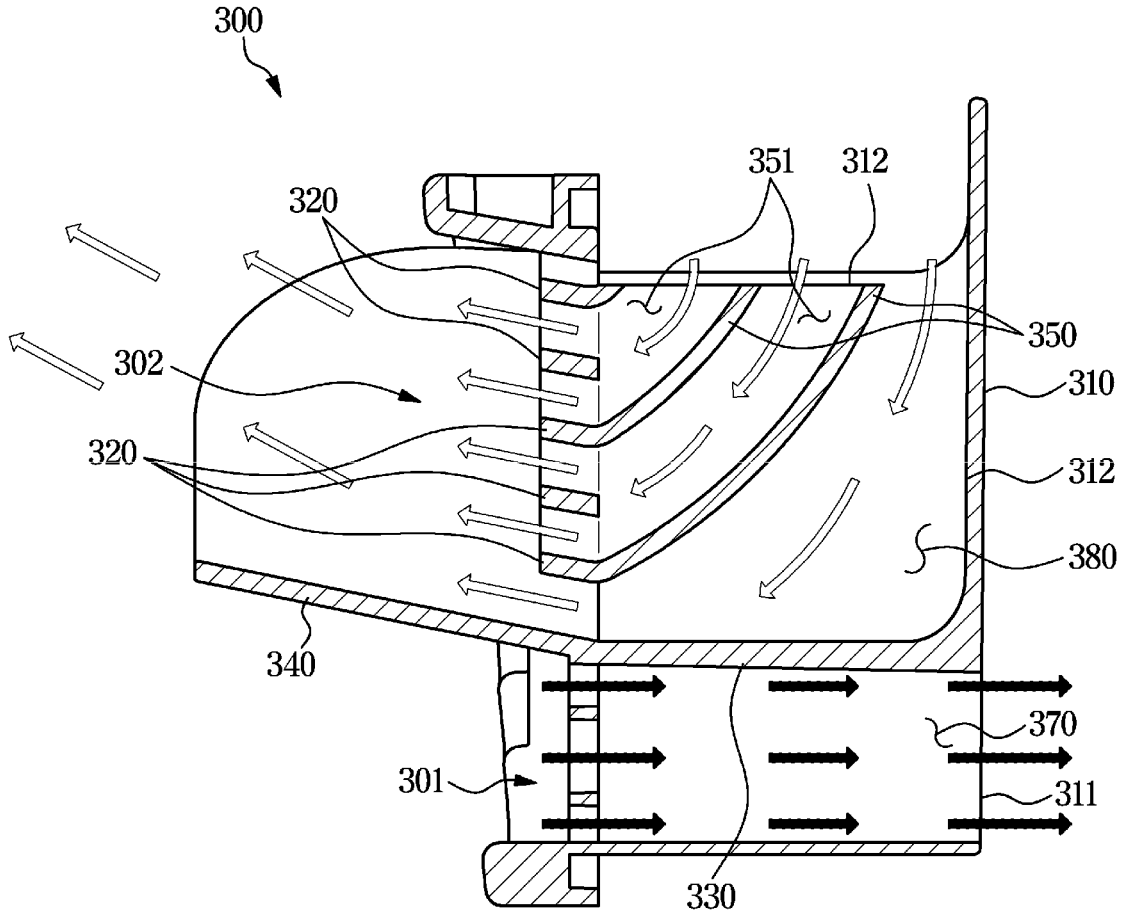
FIG. 31 is a vertical cross-sectional view of the dehumidification unit illustrated in FIG. 23.

The dehumidification unit 300 may further include a protruding rib 340. The protruding rib 340 may protrude forward from the guide 330. For example, the protruding rib 340 may protrude from the guide 330 toward the front upper side. Referring to FIG. 31, the protruding rib 340 may guide the dehumidified air to the front upper side (i.e., in an outward direction away from the dryer and upward), and thus the dehumidified air may not be mixed with the air which has not been dehumidified. Accordingly, dehumidification efficiency may be improved.

Further, the protruding rib 340 may protrude forward to prevent the unit cover 40 from being closed. For example, the protruding rib 340 may protrude more than (beyond) the front surface 11 of the cabinet 10.

Referring to FIGS. 23, 25, 28, 30 and 31, the dehumidification unit 300 may further include a guide flange (also referred to as a guide plate) 350. For example, the dehumidification unit 300 may further include one or more guide plates 350. The guide flange 350 may extend from at least a portion of the plurality of outlet guide ribs 320 by being curved upward and backward. For example, the guide flange 350 may form a plurality of outlet guide flow paths 351 by partitioning at least a portion of the outlet flow path 380. Accordingly, the guide flange 350 may guide the air to be discharged from the intake port 312 to the outlet port 302. That is, the guide flange 350 may guide the dehumidified air to be smoothly discharged. As a result, it is possible to prevent encountering a difficulty which inhibits the smooth discharge of air (e.g., by preventing vortex generation) in which the dehumidified air flows back into the dryer 1 through the intake port 312. Therefore, dehumidification efficiency may be improved.

At least one fixer 360 may be mounted on the front surface of the dehumidification unit 300. The fixer 360 may be detachably mounted on the front surface of the dehumidification unit 300. The fixer 360 may fix the dehumidification unit 300 to the dryer 2. For example, a fixing groove corresponding to the fixer 360 may be formed inside the cabinet 10. When the fixer 360 is fitted into the fixing groove, the dehumidification unit 300 may be firmly fixed to the dryer 2.

Figure 30:
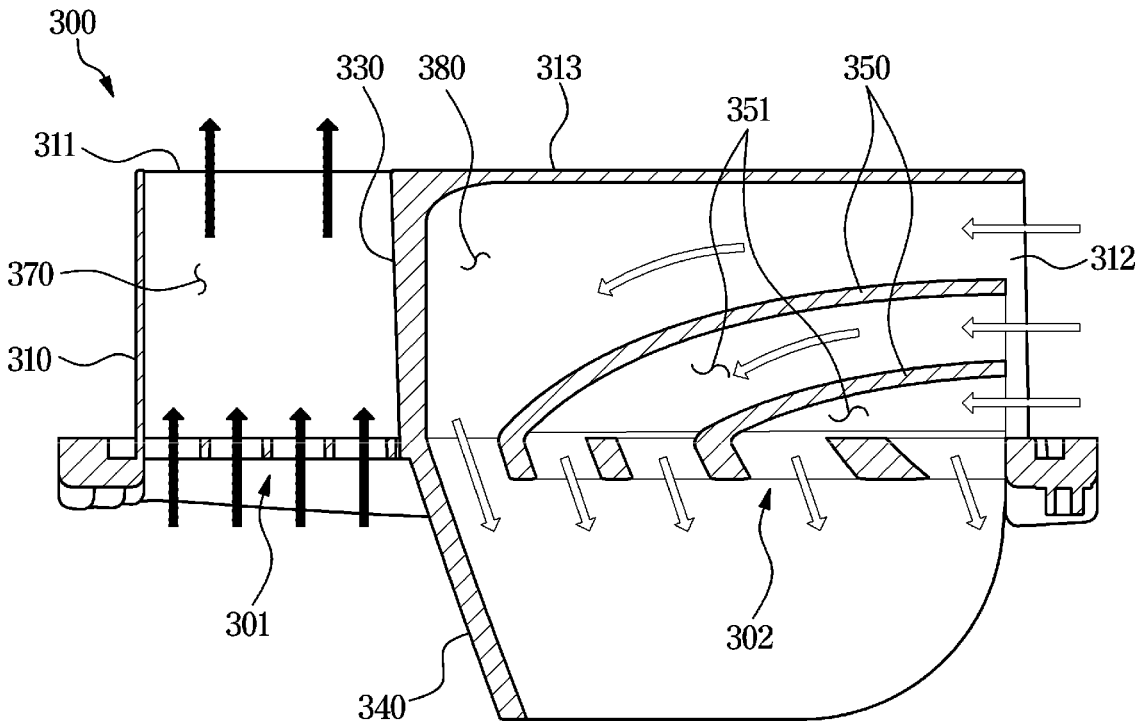
FIG. 30 is a sectional view of the dehumidification unit illustrated in FIG. 23.

With reference to FIGS. 21, 30, and 31, the flow of air will be described as follows. Outside high-humid air, that is, air which has not been dehumidified by the dryer 2, may be introduced into the body 310 of the dehumidification unit 300 through the inlet port 301. The air introduced into the body 310 may flow along the inlet flow path 370 provided inside the body 310 and pass through the discharge port 311. The air that passes through the discharge port 311 may pass through the heat exchanger 70. For example, the air which has passed through the discharge port 311 may exchange heat with the evaporator 71 and the condenser 72 while passing through the evaporator 71 and the condenser 72. Accordingly, the air which has through the heat exchanger 70 may become high-temperature and dry air. That is, the air may become dehumidified air (air after dehumidification). The dehumidified air may be introduced into the inlet 21 of the drum 20 by the blowing force of the fan 80 provided at the rear side on the base 60. The air introduced into the drum 20 may pass through an internal space 23 of drum 20 and the outlet 22. The air discharged from the drum 20 may be introduced into the intake port 312 of the dehumidification unit 300. The air introduced into the body 310 through the intake port 312 may pass through the outlet port 302 along the outlet flow path 380 and then be discharged to the outside of the dryer 2. As a result, by mounting the dehumidification unit 300 to the dryer 2, the air before dehumidification may be introduced from the outside of the cabinet 10, and the introduced air may be dehumidified by exchanging heat with the heat exchanger 70, and then discharged to the outside of the cabinet 10. By the flow of air, the dehumidifying operation (via a dehumidifying mode) may be performed.

For example, the dryer 2 may include the controller 400, the first sensor 410*a*, the second sensor 410*b*, and the detection sensor 420, described herein. For example, the dehumidification unit 300 may be interchangeable with filter unit 50. Operations of the controller 400 with respect to the first sensor 410*a*, the second sensor 410*b*, and the detection sensor 420 may be similar to those discussed above with respect to the dehumidification units 100, 200, and a detailed description thereof will be omitted. The dehumidification unit 300 may also include an identification portion or a plurality of identification portions so that the controller 400 may determine whether the dehumidification unit 300 is installed in the dryer 2, in accordance with the examples previously described herein.

In an example, the controller 400 may include a processor 440 and a non-transitory computer readable storage medium 450. The processor 440 may include, for example, an arithmetic logic unit (ALU), a central processing unit (CPU), a graphics processing unit (GPU), a digital signal processor (DSP), an image processor, a microcomputer, a field programmable array, a programmable logic unit, an application-specific integrated circuit (ASIC), a microprocessor, or combinations thereof. The non-transitory computer readable storage medium 450 may include, for example, any electronic, magnetic, optical, or other physical storage device that stores executable instructions. For example, the non-transitory computer readable storage medium 450 may include a nonvolatile memory device and/or a volatile memory. For example, the non-transitory computer readable storage medium 450 may include Read Only Memory (ROM), Programmable Read Only Memory (PROM), Erasable Programmable Read Only Memory (EPROM), flash memory, a USB drive, Random Access Memory (RAM), a hard disk, floppy disks, a blue-ray disk, CD ROM discs, DVDs, or combinations thereof.

The non-transitory computer readable storage medium 450 may include instructions that, when executed by the processor 440, cause the dryer 1, 2 to perform various functions. For example, the instructions may be instructions executed via an application or program.

The instructions stored in the non-transitory computer readable storage medium 450 may include instructions for the controller 400 to identify or determine whether the dehumidification unit 100, 200, 300 is mounted according to information (e.g., a signal) received from the first sensor 410*a* and/or the second sensor 410*b*.

For example, in response to receiving information (e.g., a signal) from the first sensor 410*a* and/or the second sensor 410*b* indicating the dehumidification unit 100, 200, 300 is mounted, the instructions may include switching to a dehumidifying mode, enabling a dehumidifying operation in a dehumidifying mode, automatically performing a dehumidifying operation in a dehumidifying mode, or combinations thereof.

For example, in response to receiving information (e.g., a signal) from the first sensor 410*a* and/or the second sensor 410*b* indicating the dehumidification unit 100, 200, 300 is not mounted, the instructions may include disabling a dehumidifying mode, preventing a dehumidifying operation in a dehumidifying mode from being performed, switching to a drying mode (e.g., the default mode), or combinations thereof.

For example, in response to receiving information (e.g., a signal) from the first sensor 410*a* and/or the second sensor 410*b* indicating the filter unit 50 is mounted, the instructions may include disabling a dehumidifying mode, preventing a dehumidifying operation in a dehumidifying mode from being performed, switching to the drying mode, automatically performing a drying operation in the drying mode, or combinations thereof.

The instructions stored in the non-transitory computer readable storage medium 450 may include instructions for the controller 400 to determine whether a dehumidifying operation can be performed by the dehumidification unit 100, 200, 300 according to information (e.g., a signal) received from the detection sensor 420, for example according to information (e.g., a signal) received from the weight detection sensor 420*a* and/or the moisture detection sensor 420*b*.

For example, in response to receiving information (e.g., a signal) from the weight detection sensor 420*a* and/or the moisture detection sensor 420*b* indicating an object is present in the drum 20, the instructions may include disabling a dehumidifying mode and/or preventing a dehumidifying operation in a dehumidifying mode from being performed. The instructions may further include controlling the manipulator 17 to output a message (textually or graphically) and/or a sound (e.g., an alarm). For example, the message and/or sound may guide or instruct a user to remove the object from the drum 20 so that a dehumidifying operation can be performed.

The instructions stored in the non-transitory computer readable storage medium 450 may include instructions for the controller 400 to identify or determine a position of the guide 230 according to information (e.g., a signal) received from the guide sensor 430.

For example, in response to receiving information (e.g., a signal) from the guide sensor 430 indicating the guide 230 is at the first position P1, the instructions may include switching to a dehumidifying mode, enabling a dehumidifying operation in a dehumidifying mode, automatically performing a dehumidifying operation in a dehumidifying mode, or combinations thereof.

For example, in response to receiving information (e.g., a signal) from the guide sensor 430 indicating the guide 230 is not at the first position P1, the instructions may include disabling a dehumidifying mode, preventing a dehumidifying operation in a dehumidifying mode from being performed, switching to a drying mode (e.g., the default mode), or combinations thereof.

For example, in response to receiving information (e.g., a signal) from the guide sensor 430 indicating the guide 230 is at the second position P2, the instructions may include disabling a dehumidifying mode, preventing a dehumidifying operation in a dehumidifying mode from being performed, switching to the drying mode, automatically performing a drying operation in the drying mode, or combinations thereof.

The instructions stored in the non-transitory computer readable storage medium 450 may include instructions for the controller 400 to inform or warn a user in response to receiving a request to perform the dehumidification operation in the dehumidifying mode, when the dehumidification operation in the dehumidifying mode cannot be performed.

For example, in response to receiving information (e.g., a signal) via the manipulator 17 to perform a dehumidifying operation in the dehumidifying mode when the dehumidifying operation cannot be performed (e.g., due to the filter unit 50 being installed, the dehumidification unit 100, 200, 300 not being installed, or the guide 230 being at a position other than the first position P1), the instructions may further include controlling the manipulator 17 to output a message (textually or graphically) and/or a sound (e.g., an alarm). For example, the message and/or sound may instruct a user to install the dehumidification unit 100, 200, 300 or to switch the position of the guide 230 so that the dehumidification operation in the dehumidifying mode may be performed.

In accordance with the above-described example embodiments, various operations of the example dryers described herein may be recorded in non-transitory computer-readable media, including program instructions to implement the various operations of the example dryers described herein. The media may also include, alone or in combination with the program instructions, data files, data structures, and the like. Examples of program instructions include both machine code, such as that produced by a compiler, and files containing higher level code that may be executed by a computer using an interpreter. The program instructions may be executed by a processor (for example processor 440 of the controller 400). The described hardware devices may be configured to act as one or more software modules in order to perform the operations of the above-described embodiments, or vice versa. In addition, the non-transitory computer-readable storage media may also be embodied as an application specific integrated circuit (ASIC) or Field Programmable Gate Array (FPGA).

While the disclosure has been described with reference to example embodiments, it should be understood by those of skilled in the art that various changes in form and details may be made without departing from the spirit and scope of the disclosure.

What is claimed is:

1. A dryer, comprising:

a cabinet;

a drum disposed inside the cabinet;

a first opening disposed on a front side of the cabinet through which an object to be dried is to be placed in the drum;

a heat exchanger disposed inside the cabinet to exchange heat with air;

a second opening disposed on the front side of the cabinet; and a dehumidification unit, accessible through the second opening, the dehumidification unit including:

an inlet port disposed on a front side of the dehumidification unit to allow air to be introduced through the second opening into the inlet port, a discharge port disposed on a rear side of the dehumidification unit to guide the air, which is introduced through the inlet port into the discharge port, to the heat exchanger, an intake port disposed on a lateral side of the dehumidification unit to allow the air, which is discharged from the drum, to be introduced into the intake port, an outlet port disposed on the front side of the dehumidification unit to allow the air, which is introduced through the intake port into the outlet port, to be discharged through the second opening, and a guide disposed to partition a first flow path extending from the inlet port to the discharge port and a second flow path extending from the intake port to the outlet port.

2. The dryer of claim 1, wherein the inlet port and the outlet port are disposed side by side in a left and right direction.

3. The dryer of claim 1, wherein with respect to a vertical line passing through a center of the first opening, the outlet port is disposed closer to the vertical line than the inlet port.

4. The dryer of claim 1, wherein the guide includes a curved portion to form a curved section in the second flow path.

5. The dryer of claim 1, further comprising:

a discharge rib which protrudes from the guide horizontally to at least partially divide the second flow path into upper and lower regions.

6. The dryer of claim 1, wherein the inlet port is disposed on a right side of the outlet port, the inlet port includes a plurality of inlet guide ribs extending in an oblique direction is disposed in the inlet port to allow air to be introduced from a lower right direction, and the outlet port includes a plurality of outlet guide ribs extending in an oblique direction is disposed in the outlet port to allow air to be discharged to an upper left direction.

7. The dryer of claim 1, wherein the dehumidification unit includes an identification portion, and the dryer is configured to detect whether the dehumidification unit is mounted to the cabinet based on the identification portion.

8. The dryer of claim 1, wherein an area occupied by the inlet port is a same area occupied by the outlet port.

9. The dryer of claim 1, wherein the dehumidification unit is attachable to and detachable from the cabinet through the second opening, the dehumidification unit further includes a protrusion disposed between the inlet port and the outlet port, and when the dehumidification unit is mounted to the cabinet, the protrusion protrudes outwardly beyond the front side of the cabinet.

10. The dryer of claim 9, further comprising:

a unit cover configured to open and close the second opening, wherein in a state in which the dehumidification unit is mounted to the cabinet, the unit cover is in an open position and is prevented from being moved to a closed position by the protrusion.

11. The dryer of claim 1, wherein the guide is moveable between a first position at which the guide partitions the first flow path and the second flow path, and a second position at which a third flow path extending from the intake port to the discharge port is formed.

12. The dryer of claim 11, wherein the guide is rotatable between the first position and the second position.

13. The dryer of claim 1, wherein the heat exchanger is accessible through the second opening, and the dehumidification unit is interchangeable with a filter unit configured to provide a third flow path for supplying air which is discharged from the drum during a drying operation to the heat exchanger, and the dryer further comprises:

a first sensor configured to detect a first identification portion disposed on the filter unit;

a second sensor configured to detect a second identification portion disposed on the dehumidification unit; and a controller configured to determine whether to perform a dehumidifying operation using the dehumidification unit, based on information received from the second sensor.

14. A dehumidification unit mountable to a dryer having a cabinet, a heat exchanger, and a drum, the dehumidification unit comprising:

a body;

an inlet port disposed on a front side of the body that, when the dehumidification unit is mounted to the dryer, is to allow air outside of the cabinet to be introduced through an opening of the cabinet into the inlet port;

a discharge port disposed on a rear side of the body that, when the dehumidification unit is mounted to the dryer, is to guide the air, which is introduced through the inlet port into the discharge port, to the heat exchanger;

an intake port disposed on a lateral side of the body that, when the dehumidification unit is mounted to the dryer and the air guided to the heat exchanger from the discharge port is circulated from the heat exchanger into the drum and discharged from the drum, is to allow the air discharged from the drum to be introduced into the intake port;

an outlet port disposed on the front side of the body that, when the dehumidification unit is mounted to the dryer, is to allow the air, which is introduced through the intake port into the outlet port, to be discharged through the opening of the cabinet; and a guide disposed to partition a first flow path extending from the inlet port to the discharge port and a second flow path extending from the intake port to the outlet port.

15. A dryer, comprising:

a cabinet;

a drum disposed inside the cabinet;

a heat exchanger disposed inside the cabinet; and a dehumidification unit configured to:

introduce air from outside the cabinet to the heat exchanger via a first flow path disposed in the dehumidification unit, to lower a humidity of the air, wherein the air is introduced from the outside via an inlet port disposed on a front side of the dehumidification unit, and is discharged to the heat exchanger via a discharge port disposed on a rear side of the dehumidification unit, receive, via the drum, that has passed through the heat exchanger and the drum, and discharge the air received via the drum to the outside of the cabinet via a second flow path disposed in the dehumidification unit and partitioned from the first flow path.

* * * * *